US012305663B2

(12) United States Patent
Fukada et al.

(10) Patent No.: US 12,305,663 B2
(45) Date of Patent: May 20, 2025

(54) CENTRIFUGAL BLOWER

(71) Applicant: DENSO CORPORATION, Kariya (JP)

(72) Inventors: Mari Fukada, Kariya (JP); Shuzo Oda, Kariya (JP); Jun Yamaoka, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 18/623,912

(22) Filed: Apr. 1, 2024

(65) Prior Publication Data

US 2024/0247661 A1 Jul. 25, 2024

Related U.S. Application Data

(63) Continuation of application No. PCT/JP2022/036004, filed on Sep. 27, 2022.

(30) Foreign Application Priority Data

Oct. 4, 2021 (JP) ..... 2021-163354

(51) Int. Cl.
*F04D 29/28* (2006.01)
*F04D 29/38* (2006.01)
*F04D 29/66* (2006.01)

(52) U.S. Cl.
CPC ..... *F04D 29/281* (2013.01); *F04D 29/388* (2013.01); *F04D 29/66* (2013.01)

(58) Field of Classification Search
CPC ..... F04D 29/281; F04D 29/388; F04D 29/66; F04D 29/162; F04D 29/44; F04D 29/28; F04D 29/62
See application file for complete search history.

(56) References Cited

U.S. PATENT DOCUMENTS

| | | | | |
|---|---|---|---|---|
| 10,808,714 | B2 * | 10/2020 | Ishii | F04D 29/66 |
| 11,015,610 | B2 * | 5/2021 | Ishii | F04D 29/66 |
| 11,255,334 | B2 * | 2/2022 | Ishii | F04D 17/16 |
| 11,332,052 | B2 * | 5/2022 | Ishii | F04D 29/4226 |
| 11,448,077 | B2 * | 9/2022 | Ishii | F04D 29/023 |
| 11,542,952 | B2 * | 1/2023 | Suzuki | F04D 29/4246 |
| 2013/0210999 | A1 | 8/2013 | Xu et al. | |
| 2015/0315393 | A1 | 11/2015 | Xu et al. | |
| 2019/0390676 | A1 * | 12/2019 | Ishii | F04D 25/06 |

FOREIGN PATENT DOCUMENTS

| | | | |
|---|---|---|---|
| JP | 2018100414 | A | 6/2018 |
| JP | 2019203481 | A | 11/2019 |

* cited by examiner

*Primary Examiner* — Brian P Wolcott
(74) *Attorney, Agent, or Firm* — Harness, Dickey & Pierce, P.L.C.

(57) ABSTRACT

A centrifugal blower includes a plurality of blades, a shroud, a main plate and a tubular portion. An air flow passage is formed between each adjacent two of the blades. When the blades are rotated, air, which is suctioned from one axial side into a suction port is conducted through the air flow passage and is radially outwardly discharged. The shroud has a cover region, which faces another axial side and is shaped in a convex arcuate form. An axial end part of the tubular portion, which faces the one axial side, has an end surface. The end surface and a second virtual line are parallel to each other, or a distance, which is measured between the end surface and the second virtual line in the axial direction, is progressively increased from a radially inner part to a radially outer part of the end surface.

10 Claims, 21 Drawing Sheets

CENTRIFUGAL BLOWER

CROSS REFERENCE TO RELATED APPLICATIONS

This application is a continuation application of International Patent Application No. PCT/JP2022/036004 filed on Sep. 27, 2022, which designated the U.S. and claims the benefit of priority from Japanese Patent Application No. 2021-163354 filed on Oct. 4, 2021. The entire disclosures of all of the above applications are incorporated herein by reference.

TECHNICAL FIELD

The present disclosure relates to a centrifugal blower.

BACKGROUND

A previously proposed centrifugal blower includes: a plurality of blades that are arranged in a circumferential direction about a fan axis (hereinafter also referred to as a central axis); a shroud that is placed on one axial side of the blades in a fan axial direction; and a main plate that is placed on the other axial side of the blades in the fan axial direction.

A suction port is formed on a radially inner side of the shroud in a radial direction of the central axis. A back surface of the shroud, which faces the other axial side in the fan axial direction, is shaped in a curved form that progressively approaches the one axial side in the fan axial direction from a radially outer side toward a radially inner side.

An impeller cup, which supports a rotor of an electric motor from the radially outer side of the rotor, is placed on the other axial side of the main plate in the fan axial direction. A radial dimension of the impeller cup, which is measured in the radial direction of the central axis, is larger than a radial size of the suction port, which is measured in the radial direction of the central axis.

When the rotor of the electric motor is rotated about the central axis, the impeller cup is rotated about the central axis. At this time, the blades and the shroud are rotated integrally with the impeller cup. At this time, the air flow, which is suctioned into the suction port from the one axial side in the fan axial direction, is radially outwardly discharged through air passages each of which is formed between corresponding adjacent two of the blades.

SUMMARY

This section provides a general summary of the disclosure, and is not a comprehensive disclosure of its full scope or all of its features.

According to the present disclosure, there is provided a centrifugal blower that includes a plurality of blades, a shroud, a main plate and a tubular portion. The shroud covers the plurality of blades from one axial side in an axial direction of a central axis. The main plate covers the plurality of blades from another axial side which is opposite to the one axial side in the axial direction. The tubular portion is placed in an opening of the main plate and is configured to be rotated about the central axis by a rotational force of an electric motor. The plurality of blades, the shroud and the tubular portion are integrally formed in one-piece as an integrated component.

BRIEF DESCRIPTION OF DRAWINGS

The drawings described herein are for illustrative purposes only of selected embodiments and not all possible implementations, and are not intended to limit the scope of the present disclosure.

DETAILED DESCRIPTION

Figure 1:
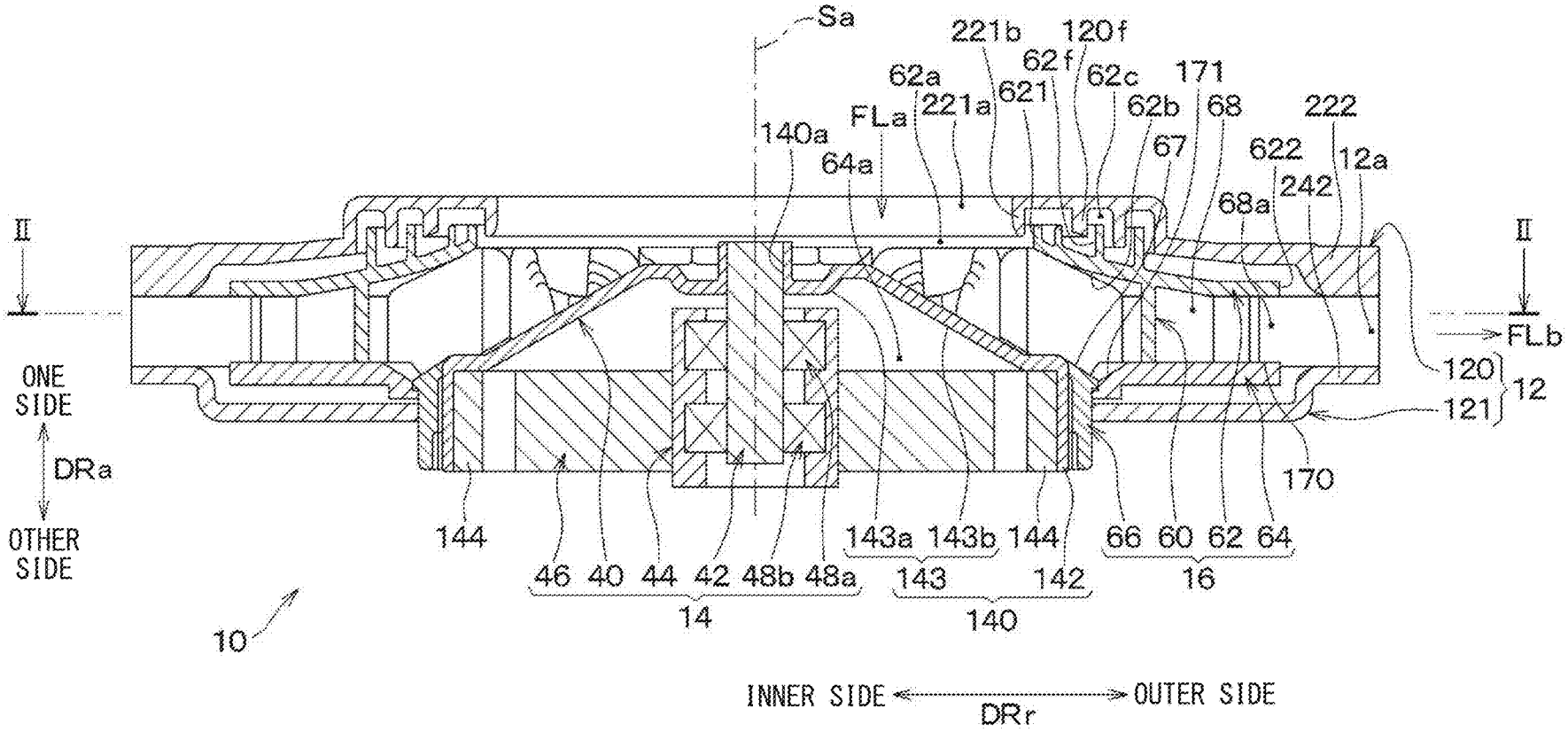
FIG. 1 is a cross-sectional view of a centrifugal blower taken along a plane that includes a fan axis of the centrifugal blower according to a first embodiment.

A previously proposed centrifugal blower includes: a plurality of blades that are arranged in a circumferential direction about a fan axis (hereinafter also referred to as a central axis); a shroud that is placed on one axial side of the blades in a fan axial direction; and a main plate that is placed on the other axial side of the blades in the fan axial direction.

A suction port is formed on a radially inner side of the shroud in a radial direction of the central axis. A back surface of the shroud, which faces the other axial side in the fan axial direction, is shaped in a curved form that progressively approaches the one axial side in the fan axial direction from a radially outer side toward a radially inner side.

An impeller cup, which supports a rotor of an electric motor from the radially outer side of the rotor, is placed on the other axial side of the main plate in the fan axial direction. A radial dimension of the impeller cup, which is measured in the radial direction of the central axis, is larger than a radial size of the suction port, which is measured in the radial direction of the central axis.

When the rotor of the electric motor is rotated about the central axis, the impeller cup is rotated about the central axis. At this time, the blades and the shroud are rotated integrally with the impeller cup. At this time, the air flow, which is suctioned into the suction port from the one axial side in the fan axial direction, is radially outwardly discharged through air passages each of which is formed between corresponding adjacent two of the blades.

In view of the previously proposed centrifugal blower discussed above, the inventors of the present application have studied a possibility of reducing noise by smoothly flowing the air flow, which is suctioned into the suction port, into the air flow passages located between the shroud and the main plate.

According to the study of the inventors of the present application, in a cross-section of the shroud, which is taken along a plane including the central axis, a cover region of the shroud, which overlaps with the impeller cup in the axial direction, needs to be shaped in a convex arcuate form that is convex toward the other axial side in the fan axial direction.

However, when the shroud, the impeller cup, the blades and the main plate are integrally molded from, for example, a resin material, a restriction is imposed on the shape of the shroud in a case where the air flow passages, which are located between: the impeller cup and the main plate; and the shroud, are molded by using slide dies.

For example, in order to enable removal of the slide dies from the shroud, the impeller cup, the blades and the main plate toward the radially inner side, a slope having a slope angle, which is equal to or larger than 0 degrees, needs to be provided between the shroud and the main plate.

However, depending on the shape of the main plate, it may not be possible to achieve the slope angle which is equal to or larger than 0 degrees. As a result of the detailed study of the inventors, it is found that the cross-section of the cover region of the shroud may not be shaped in the arcuate form described above in the case where the shroud, the impeller cup, the blades and the main plate are integrally molded in one-piece.

Then, the inventors of the present application have proposed integral molding of the shroud, the blades and the impeller cup (i.e., a tubular portion) except the main plate through use of the slide dies.

According to one aspect of the present disclosure, there is provided a centrifugal blower including:

a plurality of blades that are arranged in a circumferential direction about a central axis;

a shroud that is shaped in a ring form centered on the central axis and covers the plurality of blades from one axial side in an axial direction of the central axis, wherein the shroud forms a suction port that is located on an inner side of the shroud in a radial direction of the central axis and opens in the axial direction;

a main plate that is shaped in a ring form centered on the central axis and covers the plurality of blades from another axial side which is opposite to the one axial side in the axial direction, wherein the main plate forms an opening that opens in the axial direction and is located on an inner side of the main plate in the radial direction; and a tubular portion that is placed in the opening and is shaped in a cylindrical tubular form centered on the central axis, wherein the tubular portion is configured to be rotated about the central axis by a rotational force of an electric motor, wherein:

the plurality of blades, the shroud and the tubular portion are integrally formed in one-piece as an integrated component;

an air flow passage is formed between each adjacent two of the plurality of blades at an axial location that is between:

the tubular portion and the main plate; and the shroud;

the tubular portion is coupled to the main plate in a manner that limits relative movement of the tubular portion relative to the main plate;

when the plurality of blades, the shroud, the tubular portion and the main plate are rotated toward one circumferential side in the circumferential direction by the rotational force of the electric motor, air, which is suctioned from the one axial side into the suction port in the axial direction, is conducted through the air flow passage formed between each adjacent two of the plurality of blades and is discharged toward a radially outer side in the radial direction;

the shroud has a cover region, which faces the another axial side in the axial direction and is configured to cover a side of the tubular portion which faces the one axial side in the axial direction, wherein in a cross-section of the shroud which is taken along a plane that includes the central axis, the cover region is shaped in a convex arcuate form that is convex toward the another axial side in the axial direction;

the cover region of the shroud is sloped to progressively approach the one axial side in the axial direction from a radially outer end of the cover region toward a radially inner end of the shroud in the radial direction;

an axial end part of the tubular portion, which faces the one axial side in the axial direction, has an end surface; and a line, which is perpendicular to the axial direction and is also perpendicular to the radial direction, is defined as a first virtual line, and a tangent line, which is perpendicular to the first virtual line and is tangent to the cover region, is defined as a second virtual line, and the cover region and the end surface are formed to implement that the end surface of the tubular portion and the second virtual line are parallel to each other, or a distance, which is measured between the end surface and the second virtual line in the axial direction, is progressively increased from a radially inner part of the end surface to a radially outer part of the end surface.

With the above configuration, the cover region of the shroud is shaped in the convex arcuate form which is convex toward the other axial side in the axial direction in the cross-section of the shroud taken along the plane including the central axis. The cover region of the shroud is sloped to progressively approach the one axial side in the axial direction from the radially outer end of the cover region toward the radially inner end of the shroud in the radial direction.

Therefore, the air, which is suctioned into the suction port, can smoothly flow along the cover region. Thereby, it is possible to limit the generation of the noise when the air flows into the air flow passages.

Furthermore, the cover region and the end surface are formed to implement that the end surface of the tubular portion and the second virtual line are parallel to each other, or the distance, which is measured between the end surface and the second virtual line in the axial direction, is progressively increased from the radially inner part to the radially outer part of the end surface. Therefore, in the case where the shroud, the blades and the tubular portion are molded integrally in one-piece, when a region of each air flow passage, which is located between the cover region and the end surface, is molded through use of the corresponding slide die, the slide die can be removed from the location between the cover region and end surface (slope surface) toward the radially outer side.

Therefore, it is possible to provide the centrifugal blower that enables integral molding of the shroud, the plurality of blades and the tubular portion through use of the slide dies while limiting the generation of noise.

Hereinafter, embodiments of the present disclosure will be described with reference to the drawings. For the sake of simplicity of explanation, the same reference signs are assigned to the portions that are the same or substantially equal to each other in the following respective embodiments.

First Embodiment

Hereinafter, a centrifugal blower 10 of a first embodiment will be described with reference to FIGS. 1 and 2. FIG. 1 is a cross-sectional view of the centrifugal blower 10 taken along a plane that includes a fan axis (also referred to as a central axis) Sa of the present embodiment.

An arrow DRa of FIG. 1 indicates a fan axial direction DRa of the fan axis Sa. The fan axial direction DRa is an axial direction of the fan axis Sa. An arrow DRr of FIG. 1 indicates a fan radial direction (or simply referred to as a radial direction) DRr of the fan axis Sa. FIG. 2 is a cross-sectional view taken along line II-II in FIG. 1, and an arrow Edr of FIG. 2 indicates a circumferential direction Edr about the fan axis Sa. In FIG. 2, indication of a cross-sectional hatching of each of a plurality of blades 60 is omitted for clarity of illustration.

Figure 2:
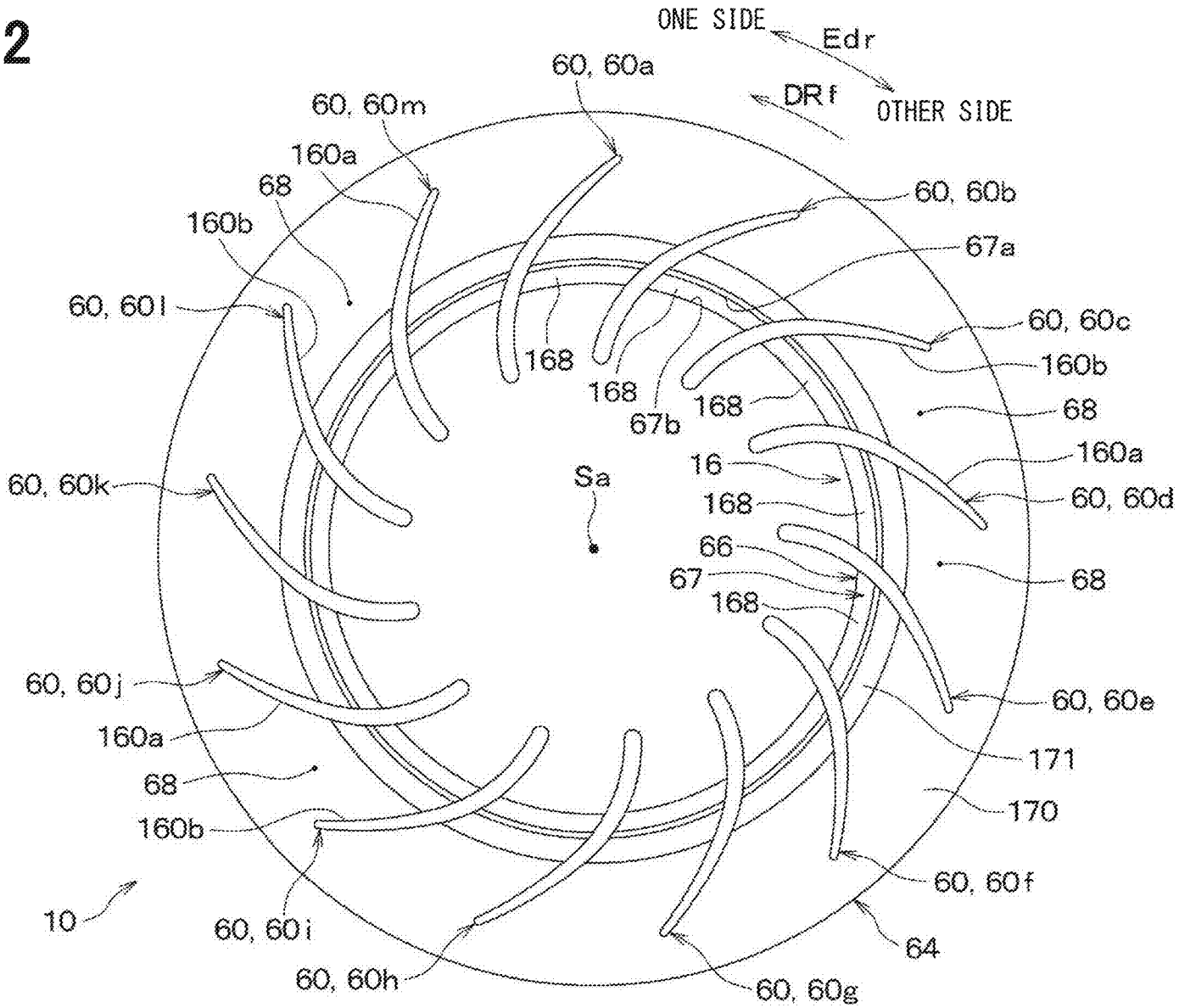
FIG. 2 is a cross-sectional view taken along line II-II in FIG. 1 for assisting explanation of a main plate, a plurality of blades and a slope surface of an impeller cup while omitting an electric motor according to the first embodiment.

As shown in FIGS. 1 and 2, the centrifugal blower 10 is a turbo blower and includes a casing 12, an electric motor 14 and an impeller 16.

The casing 12 protects the electric motor 14 and the impeller 16 from dust and dirt outside of the centrifugal blower 10. The casing 12 receives the electric motor 14 and the impeller 16. The casing 12 is made of, for example, a resin material. The casing 12 is shaped generally in a circular disk form having a larger radial size in the fan radial direction DRr in comparison to the impeller 16.

The casing 12 includes a first cover 120 and a second cover 121. The first cover 120 is placed on one axial side (or simply referred to as one side) of the impeller 16 in the fan axial direction DRa. The first cover 120 is formed to cover the impeller 16 from the one axial side in the fan axial direction DRa.

The first cover 120 is shaped in a ring form centered on the fan axis Sa. An air suction inlet 221*a* extends in the fan axial direction DRa through the first cover 120 on a radially inner side (or simply referred to as an inner side) of the first cover 120 in the fan radial direction DRr. The air suction inlet 221*a* forms an air inlet into which the air flows from the one axial side in the fan axial direction DRa.

A bell mouth 221*b* is formed at an inner periphery of the first cover 120, which forms the air suction inlet 221*a*. The bell mouth 221*b* guides the air, which flows into the air suction inlet 221*a* from the one axial side in the fan axial direction DRa relative to the centrifugal blower 10, to an air suction port (or simply referred to as a suction port) 62*a* of the shroud 62.

As shown in FIG. 1, the first cover 120 has a first outer peripheral portion 222 at a radially outer portion of the first cover 120 which faces a radially outer side (or simply referred to as an outer side) in the the fan radial direction DRr. The first outer peripheral portion 222 extends in the circumferential direction Edr.

The second cover 121 is shaped in a ring form centered on the fan axis Sa. The second cover 121 is placed on the other axial side (or simply referred to as the other side) of the blades 60, the shroud 62 and the main plate 64 of the impeller 16 in the fan axial direction DRa. The second cover 121 covers the blades 60, the shroud 62 and the main plate 64 from the other axial side in the fan axial direction DRa.

The second cover 121 has a second outer peripheral portion 242 at a radially outer portion of the second cover 121 which faces the radially outer side in the fan radial direction DRr. The second outer peripheral portion 242 extends in the circumferential direction Edr.

The second outer peripheral portion 242 cooperates with the first outer peripheral portion 222 to form an air discharge outlet 12*a* through which the air outputted from the impeller 16 is discharged. The air discharge outlet 12*a* circumferentially extends all around the fan axis Sa at the casing 12.

A plurality of support columns (not shown) are provided between the first outer peripheral portion 222 and the second outer peripheral portion 242. The support columns are arranged in the circumferential direction Edr. The support columns join between the first outer peripheral portion 222 and the second outer peripheral portion 242.

As shown in FIG. 1, the electric motor 14 is placed on the radially inner side of the second cover 121 and is centered on the fan axis Sa. The electric motor 14 is an outer rotor brushless DC motor. In the present embodiment, a maximum size of the electric motor 14 measured in the fan radial direction DRr is larger than a maximum size of the air suction port 62*a* of the shroud 62 measured in the fan radial direction DRr.

The electric motor 14 includes a rotor 40, a rotatable shaft 42, a stator housing 44, a plurality of stator coils 46 and bearings 48*a*, 48*b*. The rotor 40 includes a rotor cup 140 and a plurality of permanent magnets 144. The rotor cup 140 is made of a magnetic material (e.g., iron) and is shaped generally in a cylindrical tubular form centered on the fan axis Sa.

Specifically, the rotor cup 140 has a cylindrical tubular portion 142 and a cover portion 143. The cylindrical tubular portion 142 is shaped in a cylindrical tubular form and is centered on the fan axis Sa. The cover portion 143 is placed on the one axial side of the cylindrical tubular portion 142 in the fan axial direction DRa.

The cover portion 143 is formed to cover the cylindrical tubular portion 142 from the one axial side in the fan axial direction DRa. Specifically, the cover portion 143 includes: a boss portion 143*a* that forms a recess 140*a*, in which the rotatable shaft 42 is fixed; and a slope portion 143*b* that is placed between the boss portion 143*a* and the cylindrical tubular portion 142.

The slope portion 143*b* is sloped to progressively approach the other axial side in the fan axial direction DRa from the radially inner side toward the radially outer side in the fan radial direction DRr. As described later, the slope portion 143*b* guides the air, which is suctioned through the air suction inlet 221*a* and the air suction port 62*a*, toward the radially outer side in the fan radial direction DRr.

The permanent magnets 144 are arranged in the circumferential direction Edr at an inside of the cylindrical tubular portion 142 located on the radially inner side in the fan radial direction DRr. The permanent magnets 144 are fixed to an inner peripheral surface of the cylindrical tubular portion 142.

The rotatable shaft 42 is shaped in a cylindrical rod form and is centered on the fan axis Sa. One end portion of the rotatable shaft 42, which faces the one axial side in the fan axial direction DRa, is fitted into the recess 140*a* of the rotor cup 140. Thereby, the rotatable shaft 42 is fixed to the rotor cup 140. The rotatable shaft 42 is made of a metal material, such as iron, stainless steel, or brass.

The stator housing 44 is shaped in a cylindrical tubular form and is centered on the fan axis Sa. The stator housing 44 is placed on the radially outer side of the rotatable shaft 42 in the fan radial direction DRr.

The bearings 48*a*, 48*b* are placed between the stator housing 44 and the rotatable shaft 42. The bearings 48*a*, 48*b* are arranged in the fan axial direction DRa. The bearings 48*a*, 48*b* are supported by the stator housing 44 and support the rotatable shaft 42 in a manner that enables rotation of the rotatable shaft 42 about the fan axis Sa.

The stator coils 46 include a plurality of windings formed by winding electrical wires. The windings are arranged in the circumferential direction Edr. The stator coils 46 apply a rotating magnetic field to the permanent magnets 144 of the rotor 40 and thereby apply a rotational force to the rotor 40 to rotate the rotor 40 about the fan axis Sa.

As shown in FIG. 1, the impeller 16 is a centrifugal impeller that is applied to the centrifugal blower 10. When the impeller 16 is rotated about the fan axis Sa in a fan rotational direction DRf, the impeller 16 suctions the air from the one axial side in the fan axial direction DRa through the air suction inlet 221*a*, as indicated by an arrow FLa.

The fan rotational direction DRf of the present embodiment refers to one circumferential side (or simply referred to as one side) in the circumferential direction Edr. The impeller 16 discharges the suctioned air toward the radially outer side of the impeller 16 about the fan axis Sa, as indicated by an arrow FLb.

Specifically, the impeller 16 of the present embodiment includes the blades 60, the shroud 62, the main plate 64 and an impeller cup (also referred to as a tubular portion) 66. For the descriptive purpose, as shown in FIG. 2, the blades 60 are also individually referred to as the blades 60*a*, 60*b*, 60*c*, 60*d*, 60*e*, 60*f*, 60*g*, 60*h*, 60*i*, 60*j*, 60*k*, 60*l*, 60*m*.

Figure 3:
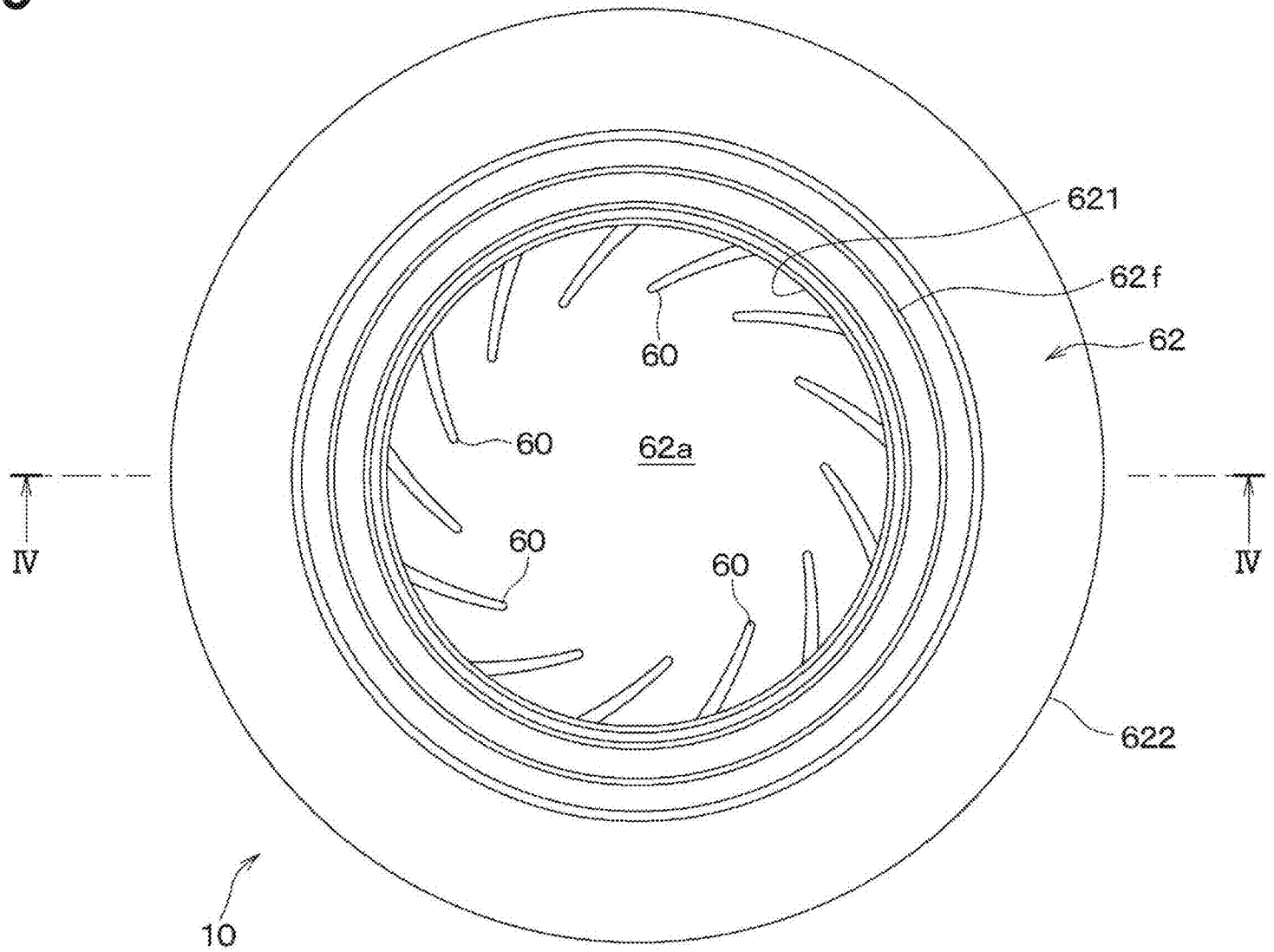
FIG. 3 is a view of a shroud and an air suction port in FIG. 1 seen from one side in a fan axial direction according to the first embodiment.

As shown in FIGS. 1, 2 and 3, the blades 60 are arranged in the circumferential direction Edr. As shown in FIG. 2, each of the blades 60 has a positive pressure surface 160*a* and a negative pressure surface 160*b* which form a blade shape.

At each of the blades 60, the positive pressure surface 160*a* faces the one circumferential side (i.e., the fan rotational direction DRf) in the circumferential direction Edr. The positive pressure surface 160*a* is a surface of the blade 60 that receives a positive pressure when the impeller 16 (together with the blades 60) is rotated in the fan rotational direction DRf.

At each of the blades 60, the negative pressure surface 160*b* faces the other circumferential side (or simply referred to as the other side) in the circumferential direction Edr. The negative pressure surface 160*b* is a surface of the blade 60 that receives a negative pressure when the impeller 16 is rotated in the fan rotational direction DRf.

Specifically, as shown in FIG. 3, a radially inner portion of each of the blades 60, which faces the radially inner side in the fan radial direction DRr, is placed at an inside of the air suction inlet 221*a*.

As shown in FIG. 2, at an axial location that is between: the main plate 64 and the impeller cup 66; and the shroud 62, an air flow passage 68 is formed between each adjacent two of the blades 60. Specifically, for the descriptive purpose, each adjacent two of the blades 60 are defined as a one-side blade 60 and an other-side blade 60, respectively. The one-side blade 60 is placed on the one circumferential side of the other-side blade 60 in the circumferential direction Edr, and the other-side blade 60 is placed on the other circumferential side of the one-side blade 60 in the circumferential direction Edr. At each adjacent two of the blades 60, the air flow passage 68 is formed between the positive pressure surface 160*a* of the other-side blade 60 and the negative pressure surface 160*b* of the one-side blade 60. The air flow passage 68 is formed between the main plate 64 and the shroud 62. The air flow passage 68 is formed between the impeller cup 66 and the shroud 62.

In the present embodiment, at each adjacent two of the blades 60, the positive pressure surface 160*a* of the one-side blade 60 and the negative pressure surface 160*b* of the other-side blade 60 extend in the fan radial direction DRr while the air flow passage 68 is interposed therebetween.

Figure 4:
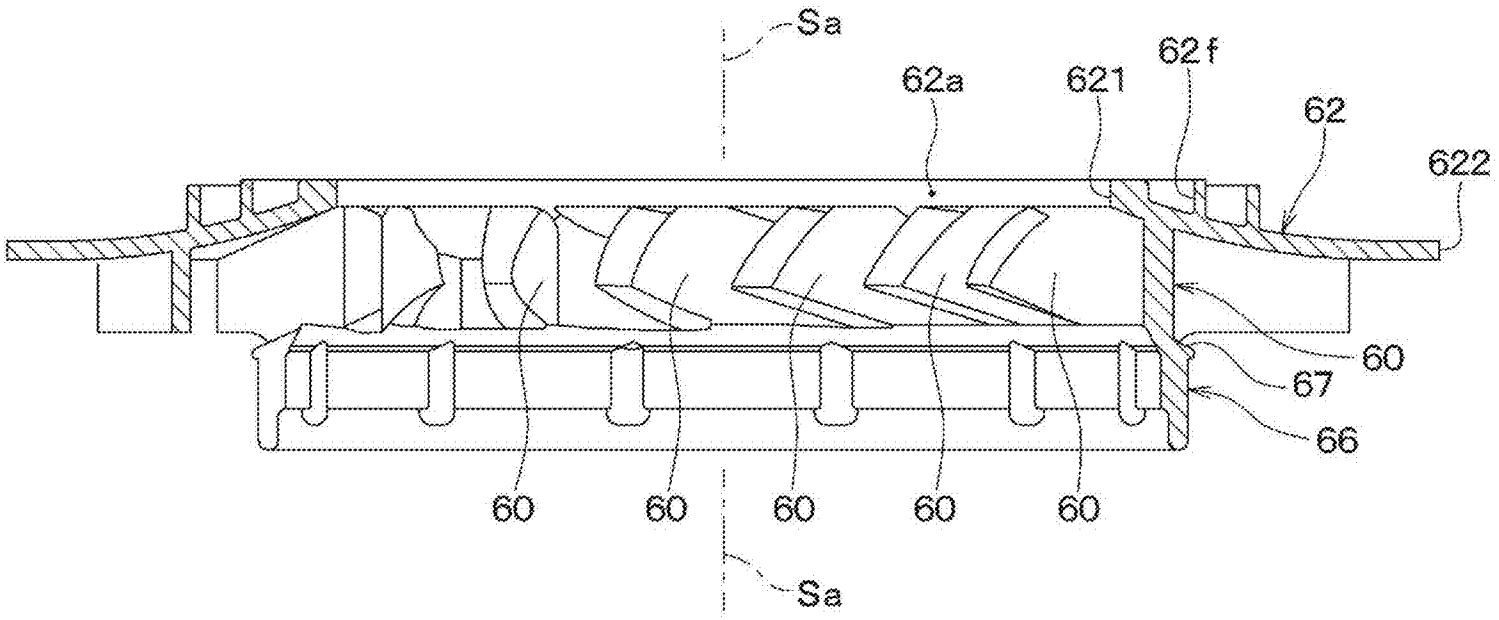
FIG. 4 is a cross-sectional view taken along line IV-IV in FIG. 3 for assisting explanation of the impeller cup and the blades according to the first embodiment.
Figure 7:
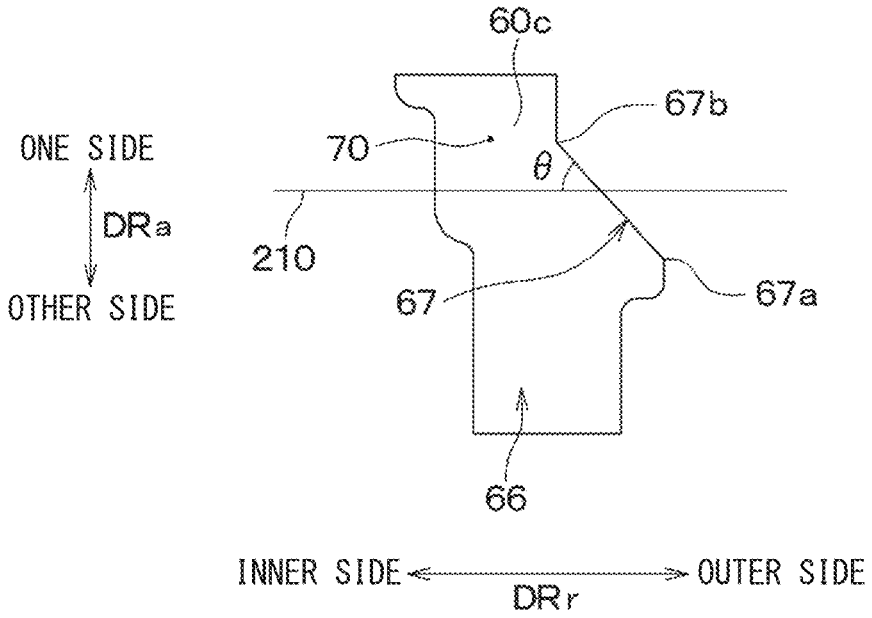
FIG. 7 is a cross-sectional view taken along line VII-VII in FIG. 6 for assisting explanation of the impeller slope angle of the slope surface of the impeller cup at a location adjacent to a negative pressure surface of the blade according to the first embodiment.
Figure 8:
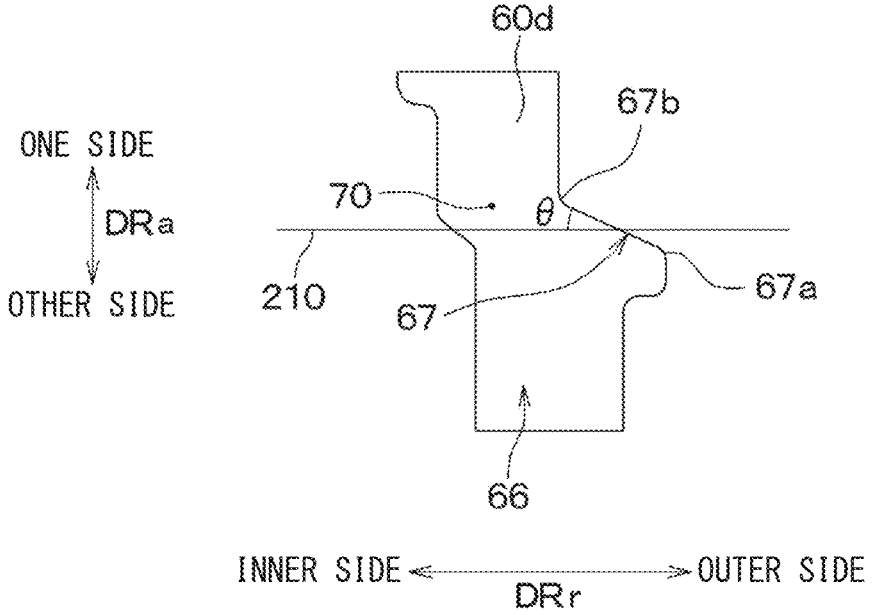
FIG. 8 is a cross-sectional view taken along line VIII-VIII in FIG. 6 for assisting explanation of the impeller slope angle of the slope surface of the impeller cup at a location adjacent to a positive pressure surface of the blade according to the first embodiment.

As shown in FIG. 1, each of the blades 60 is joined to the shroud 62. As shown in FIGS. 4, 7 and 8, each of the blades 60 is joined to the impeller cup 66. The blades 60, the shroud 62 and the impeller cup 66 are made of a resin material. The blades 60, the shroud 62 and the impeller cup 66 form an integrated component 94 which is integrally molded together through use of a plurality of slide dies 93, as described later.

A restriction, which is imposed on the molding of the blades 60, the shroud 62 and the impeller cup 66 through use of the slide dies 93 in the present embodiment, will be described later.

As shown in FIG. 1, the shroud 62 extends in the fan radial direction DRr in a circular disk form. The shroud 62 is formed to cover the blades 60 from the one axial side in the fan axial direction DRa. The shroud 62 supports the blades 60 from the one axial side in the fan axial direction DRa.

The air suction port 62*a*, through which the air flowing from the air suction inlet 221*a* of the casing 12 and suctioned as indicated by an arrow FLa, is formed on the radially inner side of the shroud 62 in the fan radial direction DRr. Therefore, the shroud 62 is shaped in a ring form.

As shown in FIGS. 1 and 4, the shroud 62 includes a ring inner peripheral end 621 and a ring outer peripheral end 622. The ring inner peripheral end 621 is a radially inner end of the shroud 62 in the fan radial direction DRr. The ring inner peripheral end 621 forms the air suction port 62*a*.

The ring outer peripheral end 622 is a radially outer end of the shroud 62 in the fan radial direction DRr. The ring outer peripheral end 622 forms an air outlet 68*a* of each of the air flow passages 68 in corporation with the blades 60 and the main plate 64.

As shown in FIG. 1, the shroud 62 is sloped to progressively approach the one axial side in the fan axial direction DRa from the ring outer peripheral end 622 toward the ring inner peripheral end 621.

Figure 15:
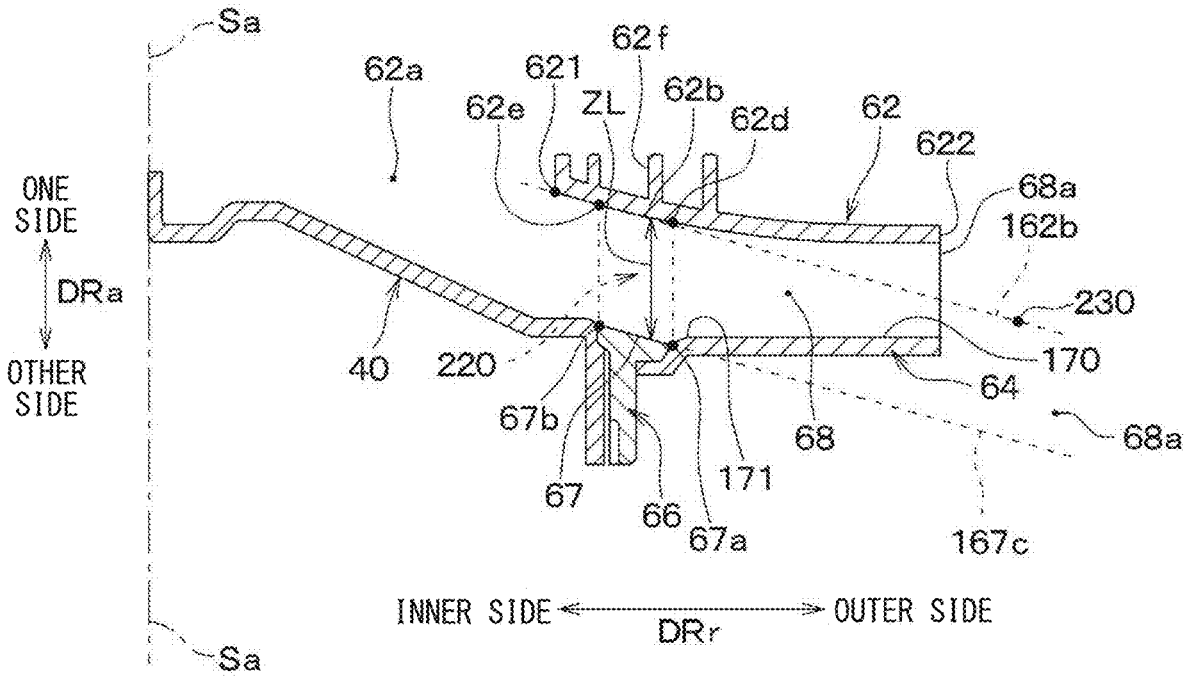
FIG. 15 is an enlarged cross-sectional view of a right half of the shroud, the impeller cup and the main plate shown in FIG. 1, which are located on a right side of the fan axis, for assisting explanation of an undercut region according to the first embodiment.

Specifically, the shroud 62 has a cover region 62*b*, which faces the other axial side in the fan axial direction DRa and overlaps with the impeller cup 66 in the fan axial direction DRa. In a cross-sectional view shown in FIGS. 1 and 15, the cover region 62*b* is shaped in a convex arcuate form that is convex toward the other axial side in the fan axial direction DRa in the cross-section thereof including the fan axis Sa. FIG. 15 is a partial enlarged cross-sectional view of a portion of FIG. 1 including the shroud 62 and the impeller cup 66.

As shown in FIG. 15, the shroud 62 is sloped to progressively approach the one axial side in the fan axial direction DRa from a radially outer end 62*d* of the cover region 62*b* toward the ring inner peripheral end 621 in the fan radial direction DRr.

Thereby, separation of the air flow, which flows in the respective air flow passages 68, away from the shroud 62 can be limited.

The shroud 62 is covered with the first cover 120 of the casing 12 from the one axial side in the fan axial direction DRa. As shown in FIG. 1, the shroud 62 forms a path forming portion 62*f*, which forms a gap 62*c* in a labyrinth form (referred to as a labyrinth structure), at a location between the shroud 62 and a path forming portion 120*a* of the first cover 120.

In the present embodiment, the labyrinth structure limits a flow of the air in the gap 62*c* between the shroud 62 and the first cover 120.

As shown in FIG. 1, the impeller cup 66 is shaped in a cylindrical tubular form which is centered on the fan axis Sa. The impeller cup 66 is placed on the radially inner side of the second cover 121 in the fan radial direction DRr. The impeller cup 66 is a tubular portion which is placed on the radially inner side of the main plate 64 in the fan radial direction DRr. Specifically, the impeller cup 66 is placed at an inside of an opening 64*a* of the main plate 64 which opens in the fan axial direction DRa.

The impeller cup 66 is placed on the radially outer side of the rotor cup 140 of the rotor 40 of the electric motor 14 in the fan radial direction DRr. The impeller cup 66 is supported relative to the rotor cup 140 of the rotor 40 of the electric motor 14. Therefore, the impeller cup 66 can be rotated about the fan axis Sa by the rotational force of the electric motor 14.

Figure 5:
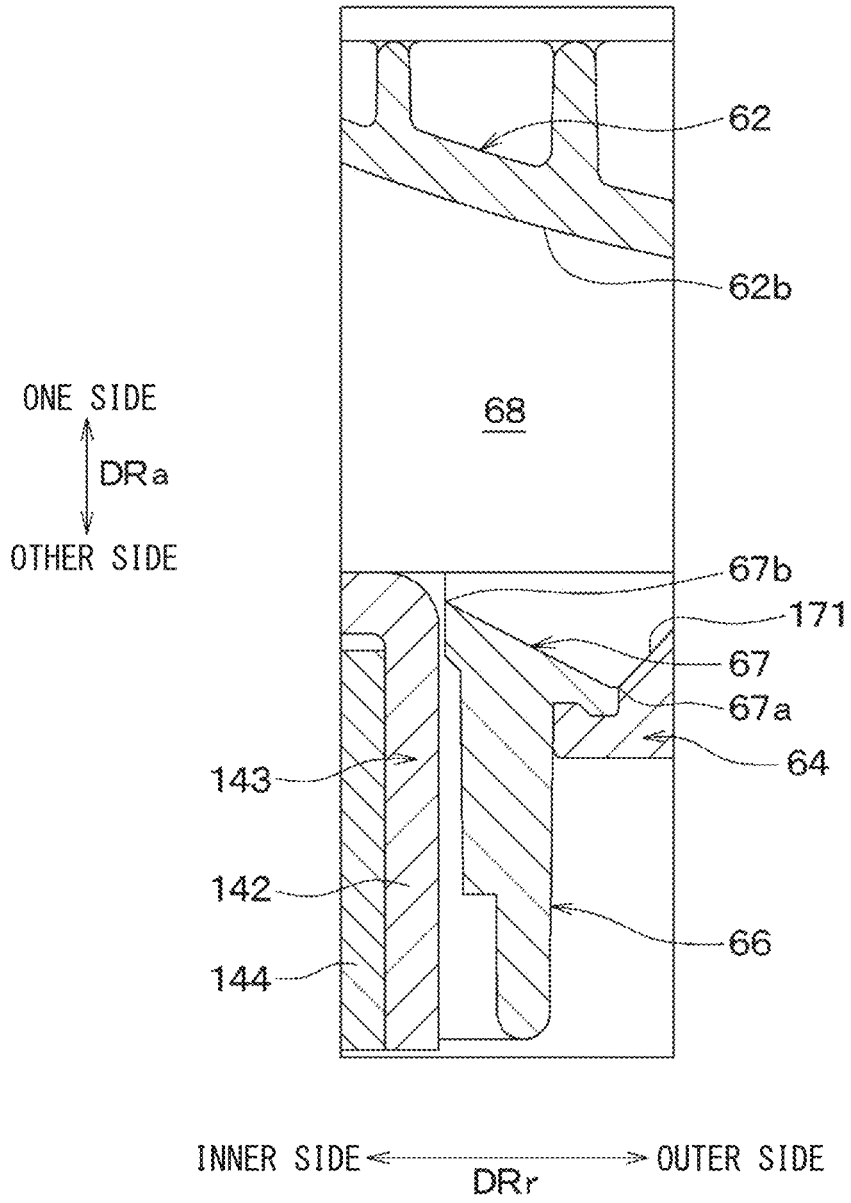
FIG. 5 is a partial enlarged cross-sectional view of a portion of FIG. 1 including a cover region of the shroud and a slope surface of the impeller cup according to the first embodiment.

As shown in FIGS. 1 and 5, a slope surface 67, which serves as an end surface, is formed at an axial end part of the impeller cup 66 which faces the one axial side in the fan axial direction DRa. The slope surface 67 is sloped to progressively approach the other axial side in the fan axial direction DRa from the radially inner side toward the radially outer side in the fan radial direction DRr.

The slope surface 67 extends in the circumferential direction Edr. The slope surface 67 is placed to overlap with the positive pressure surface 160*a* and the negative pressure surface 160*b* of each of the blades 60 in the fan axial direction DRa.

In the present embodiment, a radially outer end (also referred to as an outer peripheral end or an outer peripheral edge) 67*a* of the slope surface 67 of FIG. 2, which faces the radially outer side in the fan radial direction DRr, is placed at the same axial position in the fan axial direction DRa along an entire circumferential extent of the radially outer end 67*a* in the circumferential direction Edr.

A radially inner end (also referred to as an inner peripheral end or an inner peripheral edge) 67*b* of the slope surface 67, which faces the radially inner side in the fan radial direction DRr, is formed such that an axial position of the radially inner end 67*b* in the fan axial direction DRa varies depending on a circumferential location of the radially inner end 67*b* in the circumferential direction Edr.

In the present embodiment, as shown in FIGS. 7 and 8, an overlapping range of the impeller cup 66, which overlaps with the blades 60 in the fan axial direction DRa, has a connecting portion 70 which is joined to the blades 60.

The connecting portion 70 is placed on the radially inner side of the slope surface 67 of the impeller cup 66 in the fan radial direction DRr.

Figure 6:
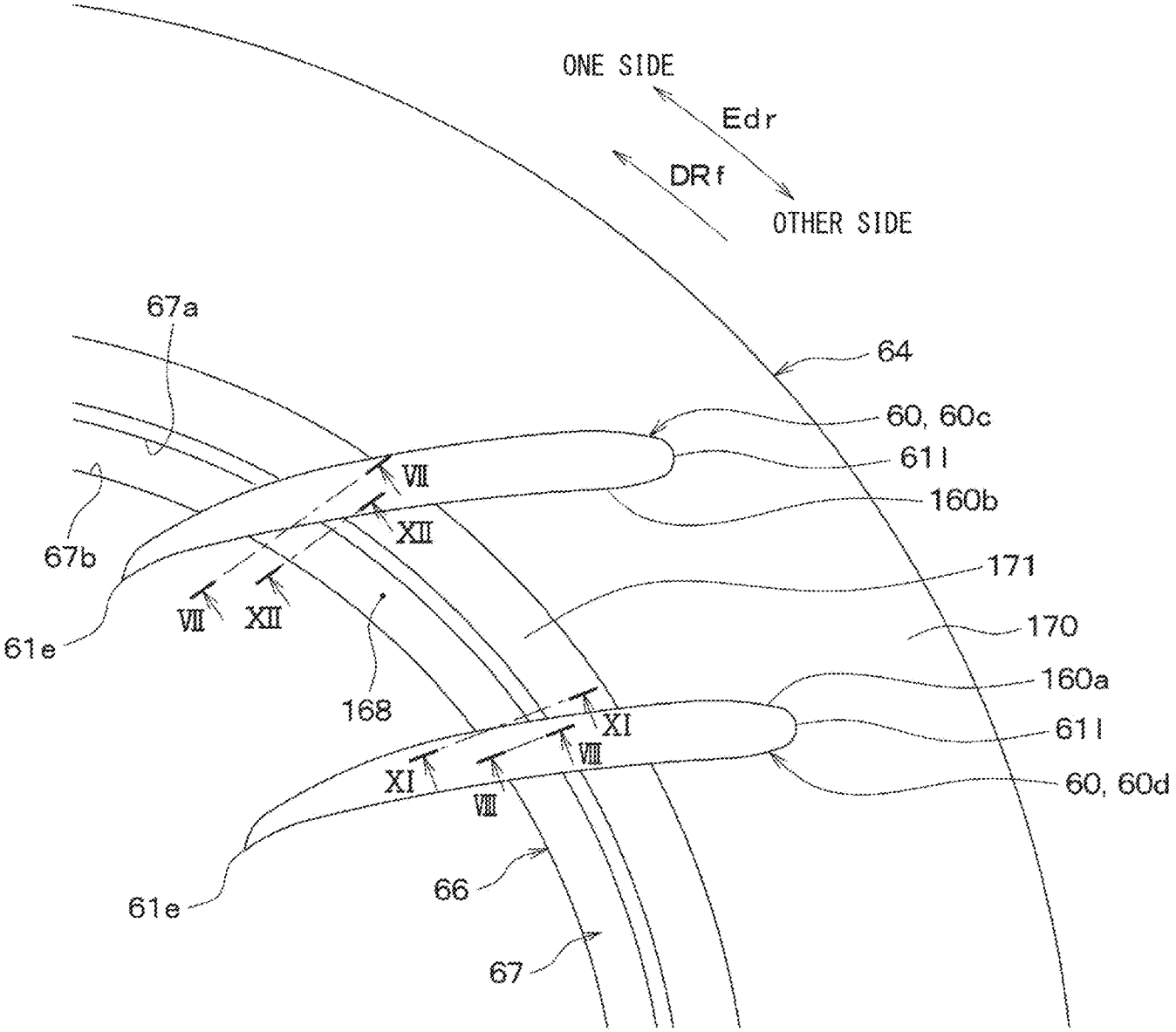
FIG. 6 is a partial enlarged view schematically indicating two blades of FIG. 2 at the slope surface of the impeller cup for assisting explanation of an impeller slope angle of the slope surface according to the first embodiment.

FIG. 7 is a cross-sectional view taken along line VII-VII in FIG. 6. FIG. 7 shows a cross-section of a portion of the slope surface 67 which is adjacent to the negative pressure surface 160*b* of the blade 60*c* and is on the other axial side of the blade 60*c* in the fan axial direction DRa. FIG. 8 is a cross-sectional view taken along line VIII-VIII in FIG. 6. FIG. 8 shows a cross-section of a portion of the slope surface 67 which is adjacent to the positive pressure surface 160*a* of the blade 60*d* and is on the other axial side of the blade 60*d* in the fan axial direction DRa. FIG. 6 is a partial enlarged view around the blades 60*c*, 60*d* of the impeller 16 shown in FIG. 2. In FIG. 6, indication of a cross-sectional hatching of the impeller cup 66 is omitted for clarity of illustration. In FIGS. 6, 7 and 8, indication of a cross-sectional hatching of each of the blades 60*c*, 60*d* is omitted for clarity of illustration.

Figure 9:
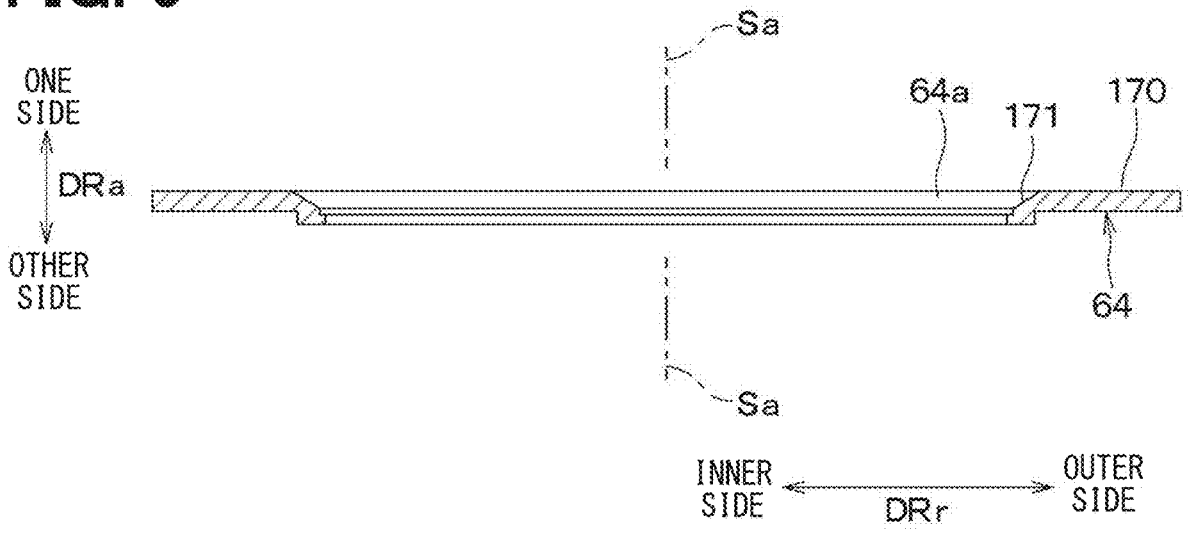
FIG. 9 is a cross-sectional view of a main plate alone in FIG. 1 taken along a plane that includes the fan axis according to the first embodiment.

As shown in FIG. 9, the main plate 64 is formed in a ring form centered on the fan axis Sa and has the opening 64*a* extending through the main plate 64 in the fan axial direction DRa. The main plate 64 is placed on the radially outer side of the impeller cup 66 in the fan radial direction DRr. The main plate 64 is formed to cover the blades 60 from the other axial side in the fan axial direction DRa.

Specifically, as shown in FIG. 9, the main plate 64 has: a main plate outer peripheral surface (also referred to as a main plate outer surface) 170 which is shaped in a ring form centered on the fan axis Sa; and a main plate inner peripheral surface (also referred to as a main plate inner surface) 171 which is placed on the radially inner side of the main plate outer peripheral surface 170 in the fan radial direction DRr.

Figure 10:
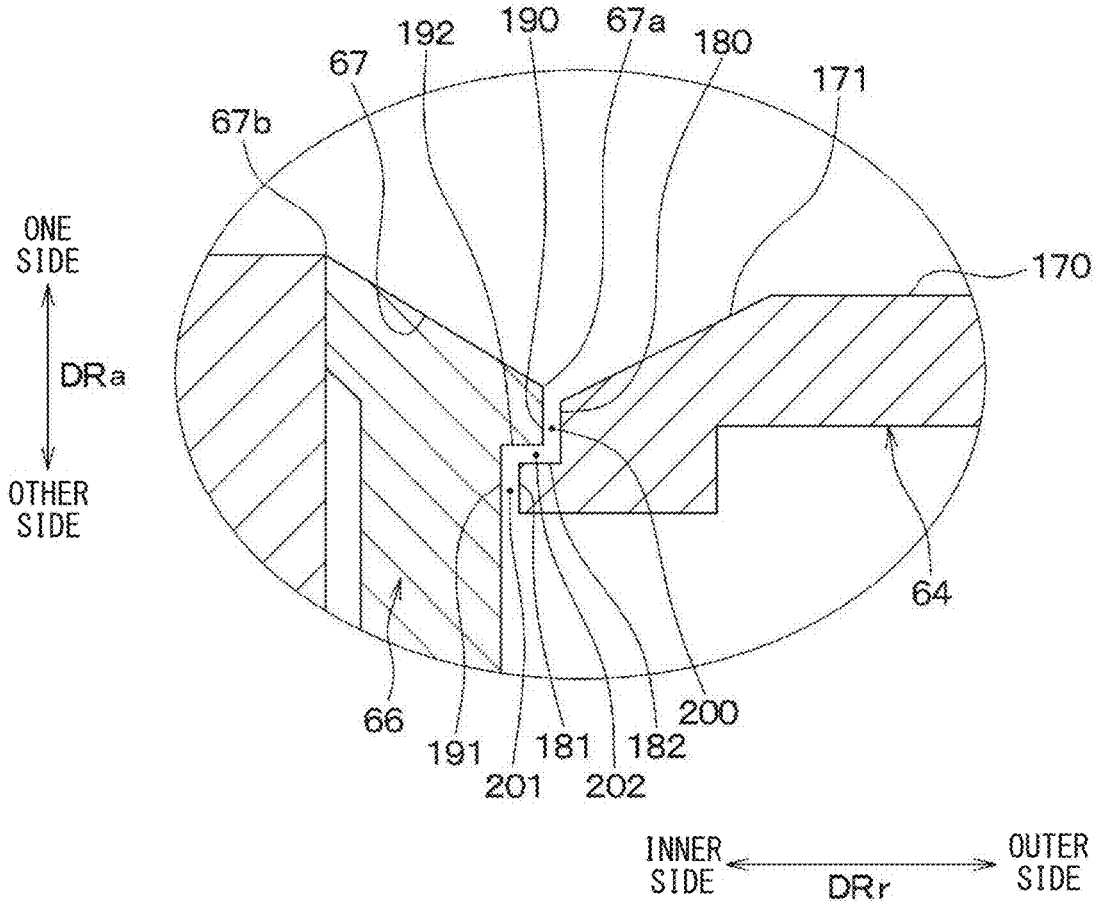
FIG. 10 is a partial enlarged cross-sectional view of a portion of FIG. 1 including the slope surface of the impeller cup and a main plate inner peripheral surface of the main plate for assisting explanation of a V-shaped recess formed by the slope surface and the main plate inner peripheral surface according to the first embodiment.

The main plate outer peripheral surface 170 is a main plate flow passage surface which is placed on the radially outer side of the slope surface 67 of the impeller cup 66 in the fan radial direction DRr. As shown in FIG. 10, the main plate outer peripheral surface 170 is placed on the one axial side of the radially outer end 67*a* of the slope surface 67 in the fan axial direction DRa. The main plate outer peripheral surface 170 extends in the circumferential direction Edr. The main plate outer peripheral surface 170 is placed on the other axial side of the shroud 62 in the fan axial direction DRa. The main plate outer peripheral surface 170 cooperates with the blades 60 and the shroud 62 to form the air flow passages 68.

The main plate inner peripheral surface 171 is radially placed between the main plate outer peripheral surface 170 and the slope surface 67 of the impeller cup 66. The main plate inner peripheral surface 171 is an inner peripheral slope surface that is sloped to progressively approach the one axial side in the fan axial direction DRa from the radially inner side toward the radially outer side in the fan radial direction DRr. The main plate inner peripheral surface 171 extends in the circumferential direction Edr. The main plate inner peripheral surface 171 cooperates with the slope surface 67 of the impeller cup 66 to form a V-shaped recess which is recessed toward the other axial side in the fan axial direction DRa.

The main plate inner peripheral surface 171 of the present embodiment has a function of guiding the air flow, which flows along the slope surface 67 of the impeller cup 66, to the main plate outer peripheral surface 170.

As shown in FIG. 10, a radially inner part of the main plate 64, which faces the radially inner side in the fan radial direction DRr, is shaped in a stepped form that includes two inner peripheral surfaces (at least two inner peripheral surfaces) 180, 181 and a radial surface 182.

The inner peripheral surfaces 180, 181 are displaced from each other in the fan radial direction DRr and extend in the fan axial direction DRa. The inner peripheral surfaces 180, 181 extend in the circumferential direction Edr. The inner peripheral surface 180 is on the radially outer side of the inner peripheral surface 181 in the fan radial direction DRr and is on the one axial side of the inner peripheral surface 181 in the fan axial direction DRa.

The radial surface 182 is a second radial surface which extends in the fan radial direction DRr. The radial surface 182 extends in the circumferential direction Edr. The radial surface 182 is placed between the inner peripheral surfaces 180, 181.

A radially outer part of the impeller cup 66, which faces the radially outer side in the fan radial direction DRr, is shaped in a stepped form that includes two outer peripheral surfaces (at least two outer peripheral surfaces) 190, 191 and a radial surface 192.

The outer peripheral surfaces 190, 191 are displaced from each other in the fan radial direction DRr and extend in the fan axial direction DRa. The outer peripheral surfaces 190, 191 extend in the circumferential direction Edr. The outer peripheral surface 190 is on the radially outer side of the outer peripheral surface 191 and is on the one axial side of the outer peripheral surface 191 in the fan axial direction DRa.

The radial surface 192 is a first radial surface which extends in the fan radial direction DRr. The radial surface 192 extends in the circumferential direction Edr. The radial surface 192 is placed between the outer peripheral surfaces 190, 191.

In the present embodiment, the radially inner part of the main plate 64, which faces the radially inner side in the fan radial direction DRr, and the radially outer part of the impeller cup 66, which faces the radially outer side in the fan radial direction DRr, are fitted with each other. Therefore, the impeller cup 66 is coupled to the main plate 64 in a manner that limits movement of the impeller cup 66 relative to the main plate 64.

The inner peripheral surface 180 and the outer peripheral surface 190 are opposed to each other through a gap 200 (i.e., a first gap). The inner peripheral surface 181 and the outer peripheral surface 191 are opposed to each other through a gap 201 (i.e., a first gap). The radial surfaces 182, 192 are opposed to each other through a gap 202 (i.e., a second gap).

The gaps 200, 201, 202 form an air flow passage shaped in a labyrinth form between the radially inner part of the main plate 64, which faces the radially inner side in the fan radial direction DRr, and the radially outer part of the impeller cup 66, which faces the radially outer side in the fan radial direction DRr.

Thereby, the labyrinth structure, which limits the flow of the air, is formed between the radially inner part of the main plate 64, which faces the radially inner side in the fan radial direction DRr, and the radially outer part of the impeller cup 66, which faces the radially outer side in the fan radial direction DRr.

Next, details of the slope surface 67 of the impeller cup 66 of the present embodiment will be described with reference to FIGS. 2, 7, 8, 11, 12 and 13.

Figure 11:
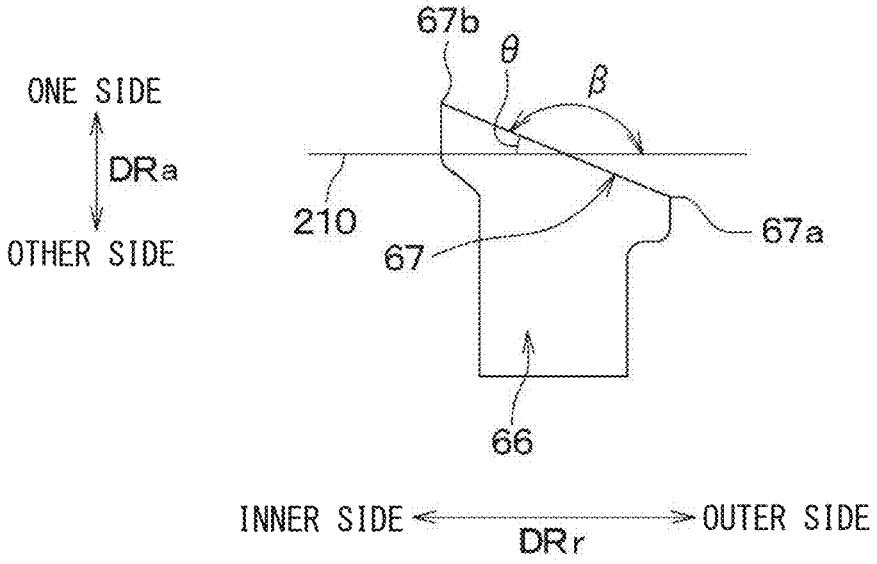
FIG. 11 is a cross-sectional view taken along line XI-XI in FIG. 6 for assisting explanation of the impeller slope angle of the slope surface of the impeller cup at the location adjacent to the positive pressure surface of the blade according to the first embodiment.
Figure 12:
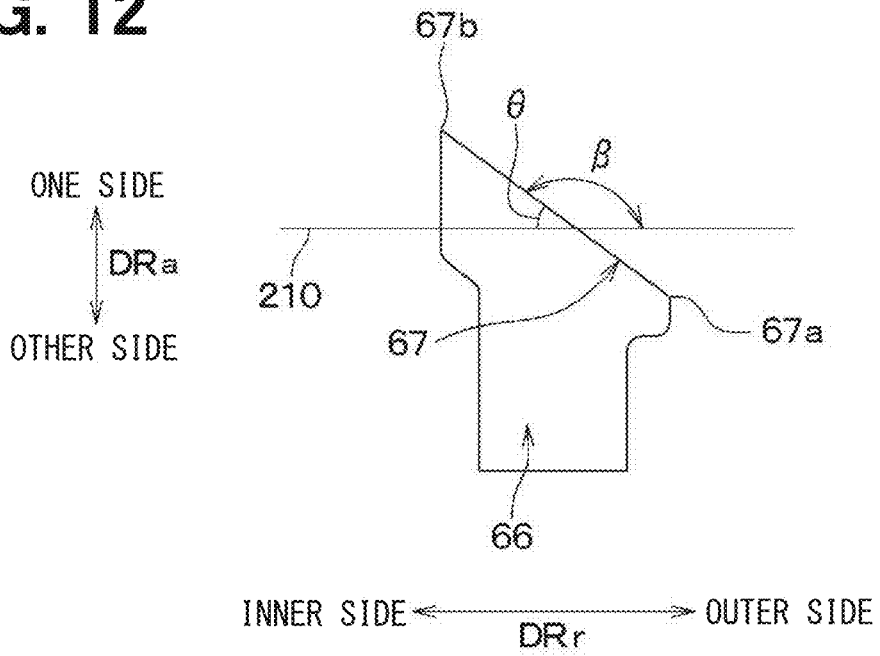
FIG. 12 is a cross-sectional view taken along line XII-XII in FIG. 6 for assisting explanation of the impeller slope angle of the slope surface of the impeller cup at the location adjacent to the negative pressure surface of the blade according to the first embodiment.

First of all, as shown in FIGS. 11 and 12, in a cross-section of the impeller cup 66 taken along a plane including the fan axis Sa, an acute angle, which is defined between the slope surface 67 and a virtual plane 210 perpendicular to the fan axis Sa, is defined as an impeller slope angle θ.

Here, as shown in FIGS. 11 and 12, the acute angle is defined as an angle θ that is a smaller angle among two angles θ, β defined between the slope surface 67 and the virtual plane 210.

FIG. 8 shows a cross-section of a region of the impeller cup 66, which overlaps with the blade 60*d* in the fan axial direction DRa and is adjacent to the positive pressure surface 160*a* of the blade 60*d*. FIG. 7 shows a cross-section of a region of the impeller cup 66, which overlaps with the blade 60*c* in the fan axial direction DRa and is adjacent to the negative pressure surface 160*b* of the blade 60*c*.

FIG. 11 shows a cross-section of an interconnecting slope portion 168, which is placed between the positive pressure surface 160*a* of the blade 60*d* and the negative pressure surface 160*b* of the blade 60*c*, and this cross-section is adjacent to the positive pressure surface 160*a* of the blade 60*d*.

FIG. 12 shows a cross-section of the interconnecting slope portion 168, which is placed between the positive pressure surface 160*a* of the blade 60*d* and the negative pressure surface 160*b* of the blade 60*c*, and this cross-section is adjacent to the negative pressure surface 160*b* of the blade 60*c*.

Each of the interconnecting slope portions 168 of the present embodiment is a region of the slope surface 67 which is between corresponding adjacent two of the blades 60. That is, the slope surface 67 form the plurality of interconnecting slope portions 168. For example, the interconnecting slope portion 168 between the blades 60*c*, 60*d* is the region of the slope surface 67 which extends from the blade 60*d* to the blade 60*c* in the fan rotational direction DRf.

The impeller slope angle θ shown in FIGS. 8 and 11 is the impeller slope angle θ of a part of the slope surface 67 which is adjacent to the positive pressure surface 160*a* of the blade 60*d* in the circumferential direction Edr. The impeller slope angle θ shown in FIGS. 7 and 12 is the impeller slope angle θ of a part of the slope surface 67 which is adjacent to the negative pressure surface 160*b* of the blade 60*c* in the circumferential direction Edr.

Here, the radially outer end 67*a* of the slope surface 67, which faces the radially outer side in the fan radial direction DRr, is placed at the same radial location in the fan radial direction DRr along the entire circumferential extent of the radially outer end 67*a* in the circumferential direction Edr. The radially outer end 67*a* of the slope surface 67, which faces the radially outer side in the fan radial direction DRr, is placed at the same axial position in the fan axial direction DRa along the entire circumferential extent of the radially outer end 67*a* in the circumferential direction Edr.

At the slope surface 67, the radially inner end 67*b* of each of the interconnecting slope portions 168, which faces the radially inner side in the fan radial direction DRr, is placed at the same radial location in the fan radial direction DRr along an entire circumferential extent of the radially inner end 67*b* of the interconnecting slope portion 168 in the circumferential direction Edr.

Figure 13:
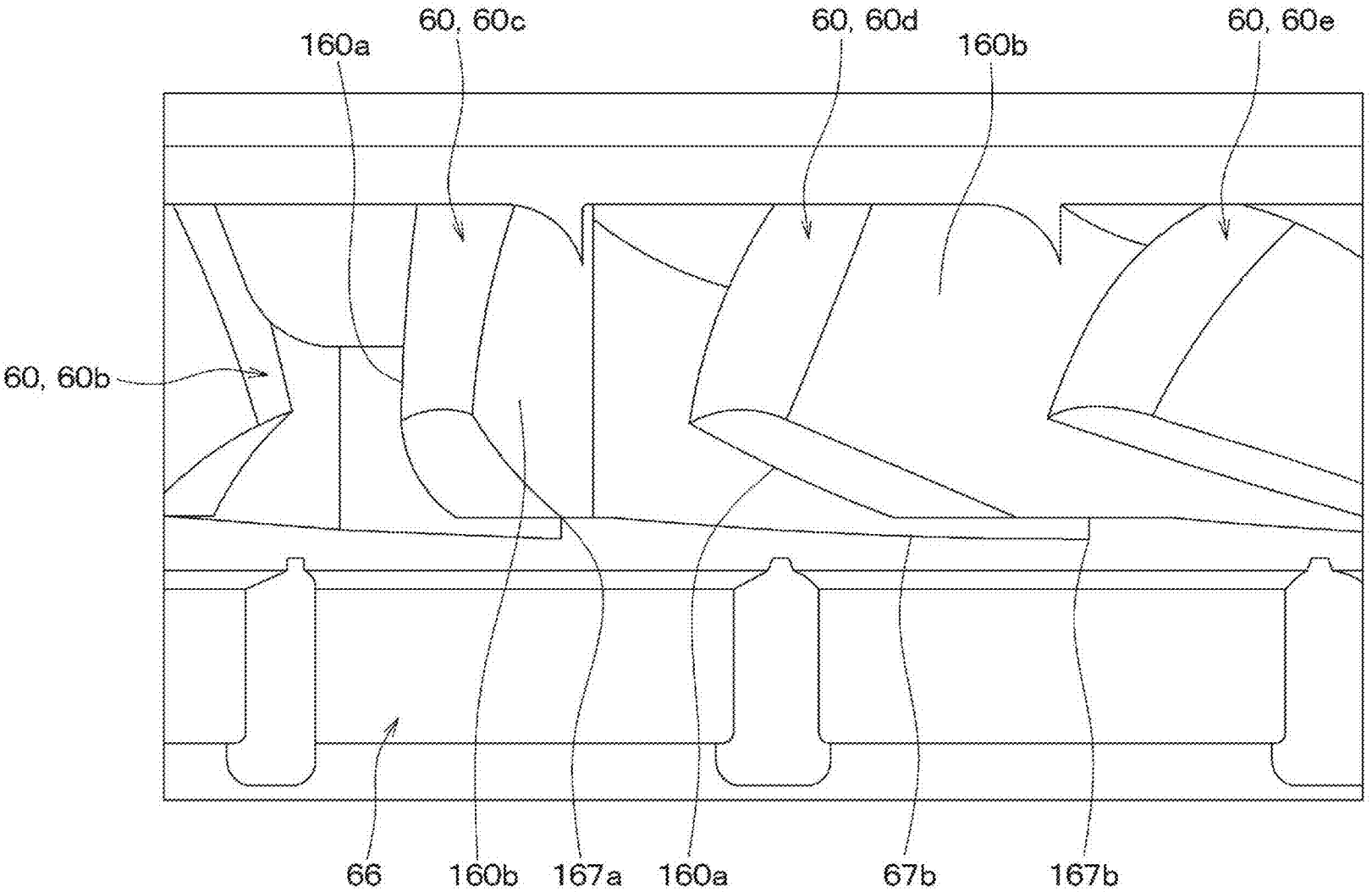
FIG. 13 is a partial enlarged view of a portion of FIG. 4 including the blades and the slope surface of the impeller cup, indicating a radially inner end of the slope surface of the impeller cup seen from a radially inner side of the slope surface in a fan radial direction according to the first embodiment.

As shown in FIG. 13, one part of the slope surface 67, which is adjacent to the positive pressure surface 160*a* of the blade 60*d*, is formed such that the radially inner end 67*b* of the one part of the slope surface 67, which faces the radially inner side in the fan radial direction DRr, is placed on the other axial side of the radially inner end 67*b* of another part of the slope surface 67, which is adjacent to the negative pressure surface 160*b* of the blade 60*c*, in the fan axial direction DRa.

Here, the radially inner end 67*b* of the slope surface 67 is sloped to progressively approach the one axial side in the fan axial direction DRa from one circumferential location, which is adjacent to the positive pressure surface 160*a* of the blade 60*d*, to another circumferential location, which is adjacent to the negative pressure surface 160*b* of the blade 60*c*, in the fan rotational direction DRf.

A reference sign 167*a* in FIG. 13 indicates a circumferential part of the radially inner end 67*b*, which is adjacent to the negative pressure surface 160*b* of the blade 60*c*. A reference sign 167*b* in FIG. 13 indicates a circumferential part of the radially inner end 67*b*, which is adjacent to the positive pressure surface 160*a* of the blade 60*d*.

Here, as shown in FIG. 15, an undercut region (or simply referred to as a region) 220 of the air flow passage 68, which is located between the slope surface 67 of the impeller cup 66 and the shroud 62, has a cross-sectional area along a plane including the fan axis Sa, and this cross-sectional area of the undercut region 220 is defined as a passage cross-sectional area.

At the interconnecting slope portion 168 between the blades 60*d*, 60*c*, the impeller slope angle θ is progressively increased toward the one circumferential side (i.e., in the fan rotational direction DRf) in the circumferential direction Edr from the one circumferential location, which is adjacent to the positive pressure surface 160*a* of the blade 60*d*, to the other circumferential location, which is adjacent to the negative pressure surface 160*b* of the blade 60*c*. Thereby, the passage cross-sectional area is progressively decreased toward the one circumferential side (i.e., in the fan rotational direction DRf) in the circumferential direction Edr from the one circumferential location, which is adjacent to the positive pressure surface 160*a* of the blade 60*d*, to the other circumferential location, which is adjacent to the negative pressure surface 160*b* of the blade 60*c*.

Therefore, at the interconnecting slope portion 168 between the blades 60*d*, 60*c*, the velocity of the air flow, which flows at the one circumferential location adjacent to the positive pressure surface 160*a* of the blade 60*d*, can be decreased, and the velocity of the air flow, which flows at the other circumferential location adjacent to the negative pressure surface 160*b* of the blade 60*c*, can be increased. Therefore, it is possible to decrease a difference between the velocity of the air flow, which flows at the one circumferential location adjacent to the positive pressure surface 160*a* of the blade 60*d*, and the velocity of the air flow, which flows at the other circumferential location adjacent to the negative pressure surface 160*b* of the blade 60*c*. Thus, it is possible to limit the generation of the noise caused by the velocity difference.

This slope shape of the interconnecting slope portion 168 between the blades 60*d*, 60*c* is equally formed at the other interconnecting slope portions 168, which are other than the interconnecting slope portion 168 between the blades 60*d*, 60*c*.

Next, the restriction, which is imposed on the molding of the blades 60, the shroud 62 and the impeller cup 66 through use of the slide dies 93 in the present embodiment, will be described with reference to FIGS. 14, 15, 16 and 17.

Figure 14:
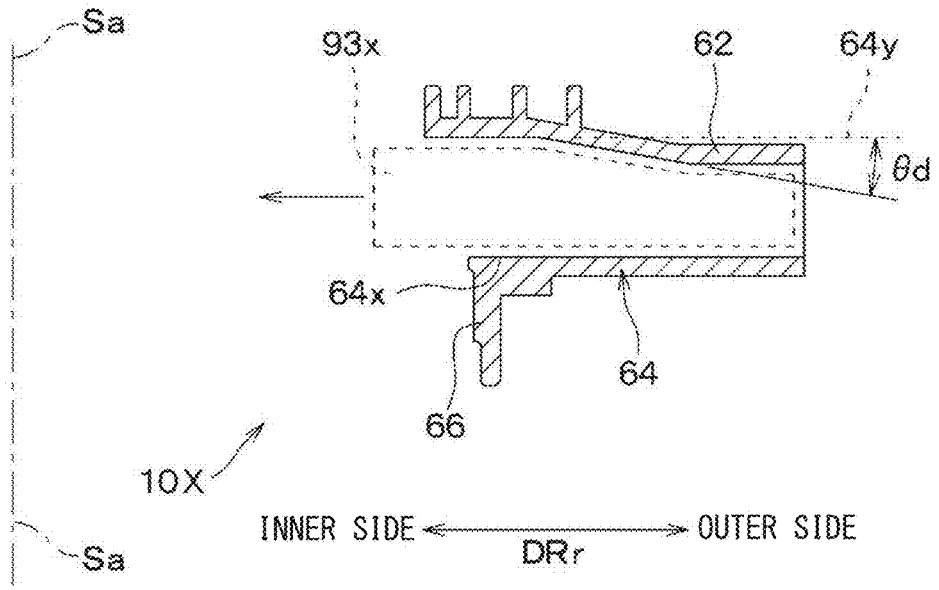
FIG. 14 is a cross-sectional view of a shroud, an impeller cup and a main plate of a centrifugal blower of a comparative example of the first embodiment taken along a plane including a fan axis for assisting explanation of a restriction imposed on integral molding of the shroud, the impeller cup, the blades and the main plate.

It is conceivable to integrally mold the blades 60, the shroud 62, the impeller cup 66 and the main plate 64 through use of the slide dies 93*x*, as shown in FIG. 14. In FIG. 14, indication of the blades 60 is omitted. In this case, for example, it is required to enable sliding and removing of the slide dies 93*x* toward the radially inner side relative to the shroud 62, the blades 60 and the main plate 64.

In this case, as shown in FIG. 14, it is required to implement a shape, in which the slope angle θd, which is equal to or larger than 0 degrees, is provided between the shroud 62 and the main plate 64.

FIG. 14 shows a cross-section of a centrifugal blower 10X of a comparative example taken along a plane including the fan axis Sa. A dotted line 64*y* shown in FIG. 14 is a virtual plane formed by translating a surface 64*x* of the main plate 64 toward the one axial side in the fan axial direction DRa.

However, depending on the shape of the main plate 64, it may not be possible to achieve the slope angle θd which is equal to or larger than 0 degrees.

In contrast, in the present embodiment, the shroud 62 is configured as shown in FIG. 15 to smoothly introduce the air, which is suctioned from the air suction port 62*a*, into the air flow passages 68. Specifically, the shroud 62 is sloped to progressively approach the one axial side in the fan axial direction DRa from the radially outer end 62*d* of the cover region 62*b* to a radially inner end 62*e* of the cover region 62*b* in the fan radial direction DRr.

Figure 16:
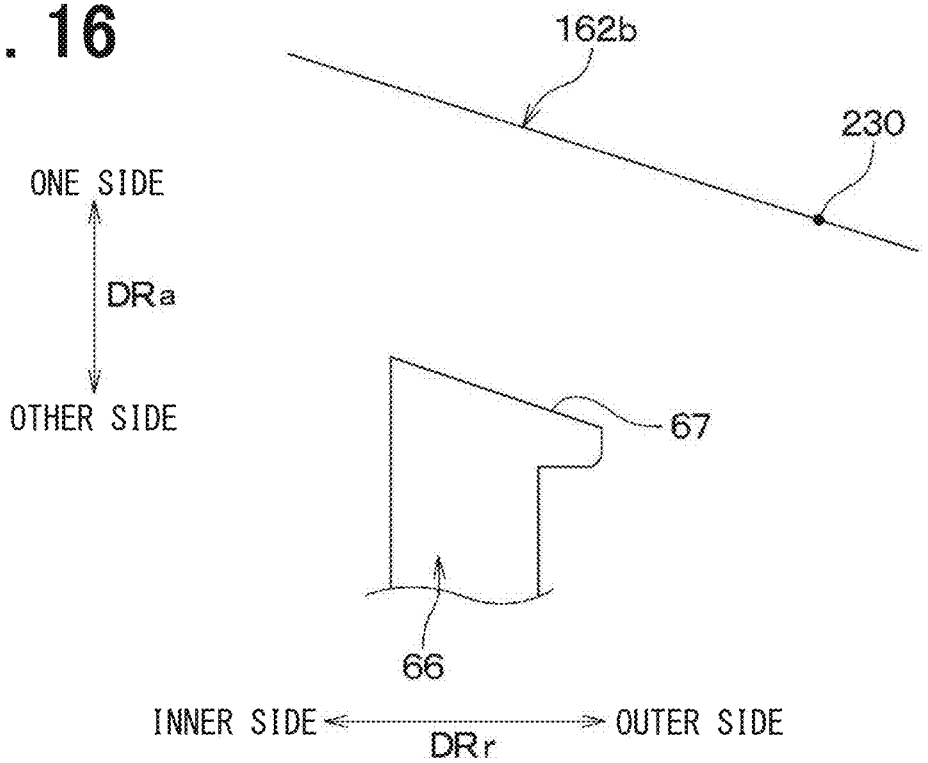
FIG. 16 is a diagram for explaining a relationship between a virtual tangent line of the cover region of the shroud and the slope surface of the impeller cup shown in FIG. 15, indicating a state where the virtual tangent line and the slope surface are parallel to each other according to the first embodiment.
Figure 17:
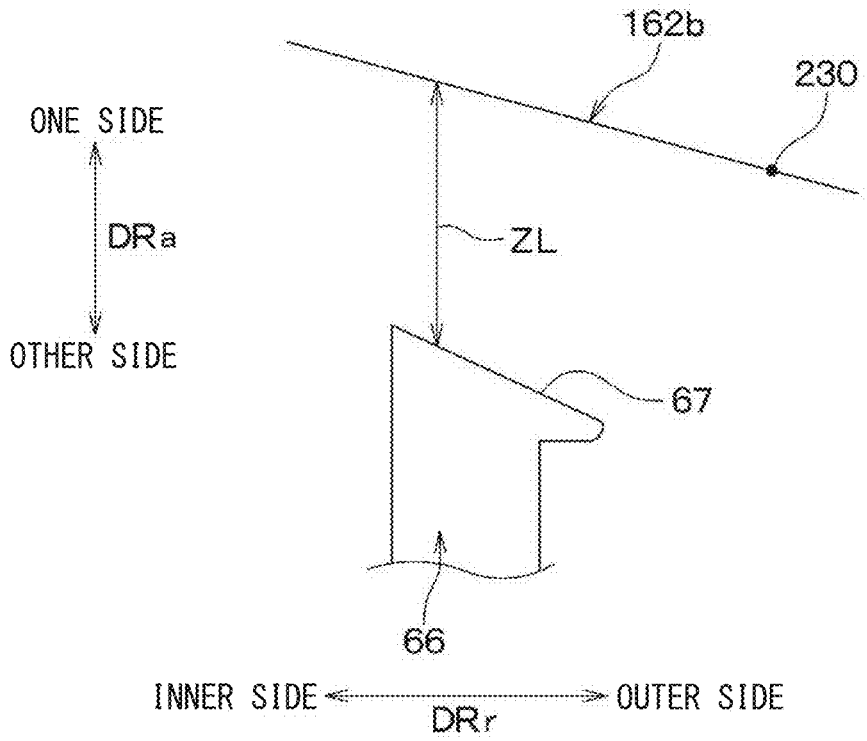
FIG. 17 is a diagram for explaining a relationship between the virtual tangent line of the cover region of the shroud and the slope surface of the impeller cup in FIG. 15, indicating a state where a distance between the virtual tangent line and the slope surface is progressively increased from a radially inner part of the slope surface to a radially outer part of the slope surface in the fan radial direction according to the first embodiment.

Here, in FIGS. 16 and 17, a line, which is perpendicular to the fan axial direction DRa and is also perpendicular to the fan radial direction DRr, is defined as a virtual line 230. In FIGS. 16 and 17, the virtual line 230 is a first virtual line that is perpendicular to a plane of the drawing.

Furthermore, a tangent line, which is perpendicular to the virtual line 230 and is tangent to the cover region 62*b*, is defined as a virtual tangent line 162*b* (i.e., a second virtual line).

As shown in FIG. 16, the cover region 62*b* and the slope surface 67 are formed to implement that the slope surface 67 and the virtual tangent line 162*b* are parallel to each other.

Alternatively, as shown in FIG. 17, the cover region 62*b* and the slope surface 67 are formed to implement that a distance ZL, which is measured between the slope surface 67 and the virtual tangent line 162*b* in the fan axial direction DRa, is progressively increased from a radially inner part to a radially outer part of the slope surface 67 in the fan radial direction DRr.

Figure 18:
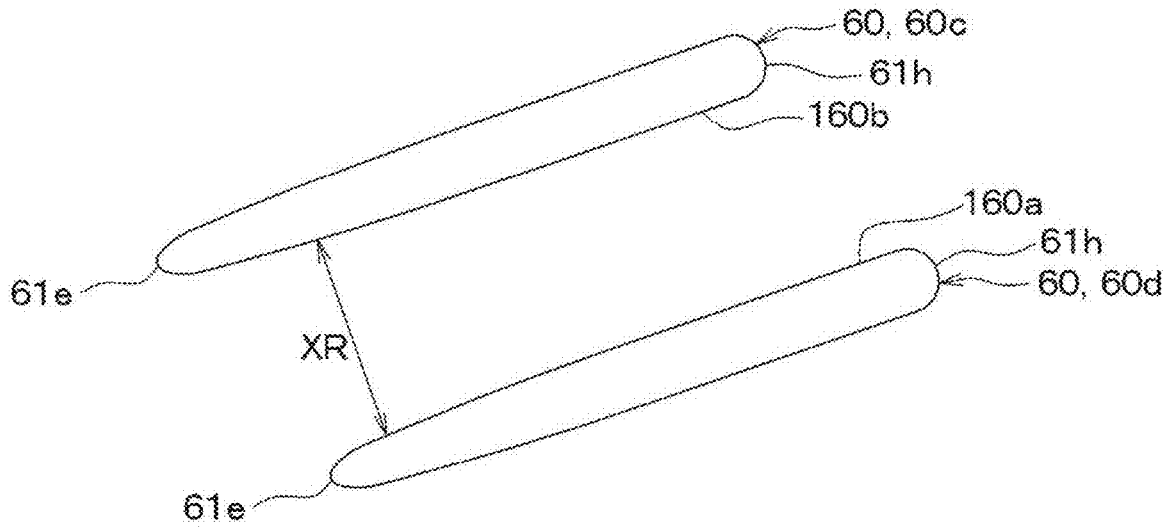
FIG. 18 is a diagram schematically showing two blades among the blades viewed from one axial side in the fan axial direction for assisting explanation of a configuration of the positive pressure surface of one of the two blades and the negative pressure surface of the other one of the two blades according to the first embodiment.

As shown in FIG. 18, a radially outer end of each of the blades 60 in the fan radial direction DRr is defined as a radially outer end 61*h*. A radially inner end of each of the blades 60 in the fan radial direction DRr is defined as a radially inner end 61*e*. In FIG. 18, indication of a cross-sectional hatching of each of the blades 60*c*, 60*d* is omitted for clarity of illustration.

The positive pressure surface 160*a* and the negative pressure surface 160*b* are formed such that a distance XR between the blades 60 is increased from the radially inner end 61*e* to the radially outer end 61*h*. The distance XR between the blades 60 is a distance between the positive pressure surface 160*a* and the negative pressure surface 160*b*.

In the present embodiment, as shown in FIG. 18, in a view taken in the fan axial direction DRa, the positive pressure surface 160*a* is shaped in a convex arcuate form that is convex toward the one circumferential side in the circumferential direction Edr.

In the view taken in the fan axial direction DRa, the negative pressure surface 160*b* is shaped in a convex arcuate form that is convex toward the one circumferential side in the circumferential direction Edr. In FIG. 18, indication of a cross-sectional hatching of each of the blades 60*c*, 60*d* is omitted for clarity of illustration.

The blades 60, the shroud 62 and the impeller cup 66 are formed in the above described manner. Therefore, the blades 60, the shroud 62 and the impeller cup 66 can be integrally molded by the die molding using the slide dies 93.

Figure 19:
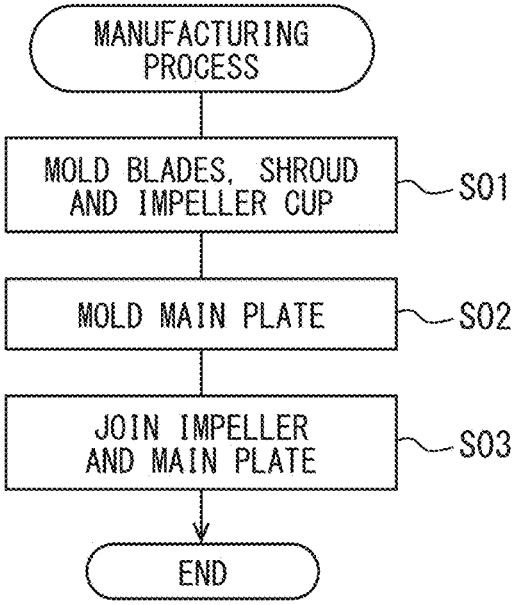
FIG. 19 is a flowchart showing details of a manufacturing process for manufacturing an impeller of FIG. 1 according to the first embodiment.

Next, a manufacturing process of the impeller 16 will be described with reference to a flowchart of FIG. 19. As shown in FIG. 19, first of all, at step S01, the blades 60, the shroud 62 and the impeller cup 66 are molded.

Figure 20:
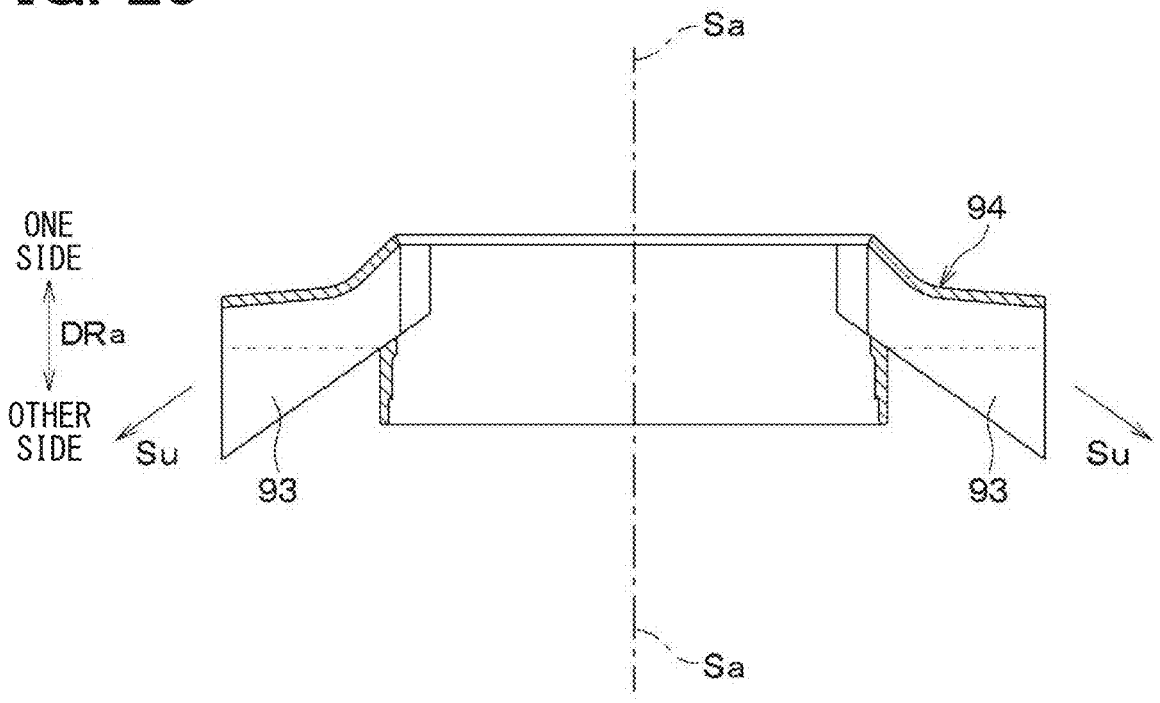
FIG. 20 is a diagram for supporting explanation of a manufacturing process for integrally molding the blades, the impeller cup and the shroud in FIG. 18 and a molding die device used in this manufacturing process according to the first embodiment.

Specifically, as shown in FIG. 20, the blades 60, the shroud 62 and the impeller cup 66 are injection molded integrally in one-piece by using a molding die device.

The die device includes a cavity die, a core die and the slide dies 93. The cavity die and the core die are configured to open and close in the fan axial direction DRa. The core die is a die that is placed on the other axial side of the cavity die in the fan axial direction DRa.

The slide dies 93 are used to form the undercut regions 220 located between the impeller cup 66 and the shroud 62. The number of the slide dies 93 is equal to the number of the air flow passages 68.

At a molding step of step S01, in a state where the slide dies 93 are arranged between the cavity die and the core die, a molten resin material is injected between the cavity die and the core die. Thereafter, the resin material is cooled and is solidified to form the integrated component 94 between the cavity die and the core die.

Furthermore, the cavity die and the core die are separated from each other in the fan axial direction DRa, and the integrated component 94 and the slide dies 93 are removed from the location between the cavity die and the core die. At this time, each of the slide dies 93 is slid toward the radially outer side in the fan radial direction DRr along the positive pressure surface 160*a* and the negative pressure surface 160*b* of the corresponding adjacent two of the blades 60.

Thereafter, as indicated by an arrow Su, each of the slide dies 93 is slid and is removed from the integrated component 94 toward the radially outer side in the fan radial direction DRr and the other axial side in the fan axial direction DRa. Thereby, the slide dies 93 are separated from the integrated component 94.

Thus, the molding of the integrated component 94, which includes the blades 60, the shroud 62 and the impeller cup 66 formed integrally in one-piece, is completed.

Next, at a molding step of step S02, the main plate 64 is formed by resin molding using a molding die device.

Then, at a joining step of step S03, the radially inner part of the main plate 64, which faces the radially inner side in the fan radial direction DRr, and the radially outer part of the impeller cup 66, which faces the radially outer side in the fan radial direction DRr, are fitted with each other, and the blades 60 are joined to the main plate 64 by bonding. Thereby, the molding of the impeller 16 is completed.

Next, an operation of the centrifugal blower 10 of the present embodiment will be described.

First of all, when a three-phase AC current flows through the stator coils 46 at the electric motor 14, the rotating magnetic field is generated at the stator coils 46. In response to this, the rotor 40 is rotated by the rotating magnetic field. At this time, the rotor 40 applies the rotational force to the impeller 16 through the impeller cup 66. Therefore, the impeller 16 is rotated in the fan rotational direction DRf.

At this time, the air, which flows from the one axial side through the air suction inlet 221*a* of the casing 12 in the fan axial direction DRa, is suctioned into the air suction port 62*a*, as indicated by the arrow FLa.

A portion of this suctioned air flows into each of the air flow passages 68.

Here, the cover region 62*b* of the shroud 62 is shaped in the convex arcuate form that is convex toward the other axial side in the fan axial direction DRa. Therefore, the air, which is suctioned into the air suction port 62*a*, flows along the shroud 62 toward the radially outer side in the fan radial direction DRr without separating the air flow from the shroud 62.

In addition, another portion of the air, which is suctioned into the air suction port 62*a* but is other than the portion of the air flowing along the shroud 62, flows along the slope portion 143*b* of the rotor cup 140, the slope surface 67 of the impeller cup 66, the main plate inner peripheral surface 171 and the main plate outer peripheral surface 170.

As described above, the air, which flows through each of the air flow passages 68, is forced to flow toward the radially outer side in the fan radial direction DRr by a centrifugal force. This flowing air is discharged from the air discharge outlet 12*a* through the air outlets 68*a*, as indicated by the arrow FLb.

According to the present embodiment described above, the centrifugal blower 10 includes the integrated component 94 which includes the blades 60, the shroud 62 and the impeller cup 66 formed integrally in one-piece, and the impeller cup 66 is fitted to the main plate 64.

The shroud 62 has the cover region 62*b*, which faces the other axial side in the fan axial direction DRa and covers the side of the impeller cup 66 which faces the one axial side in the fan axial direction DRa. The cover region 62*b* is shaped in the convex arcuate form which is convex toward the other axial side in the fan axial direction DRa in the cross-section of the shroud 62 taken along the plane including the fan axis Sa.

Here, the shroud 62 is sloped to progressively approach the one axial side in the fan axial direction DRa from the radially outer end 62*d* of the cover region 62*b* toward the ring inner peripheral end 621 in the fan radial direction DRr.

The impeller cup 66 has the slope surface 67 that is formed at the axial end part of the impeller cup 66, which faces the one axial side in the fan axial direction DRa. The slope surface 67 is sloped to progressively approach the one axial side in the fan axial direction DRa from the radially outer side toward the radially inner side in the fan radial direction DRr.

Thereby, the cover region 62*b* is shaped in the convex arcuate form which is convex toward the other axial side in the fan axial direction DRa in the cross-section of the shroud 62 taken along the plane including the fan axis Sa. Here, the shroud 62 is sloped to progressively approach the one axial side in the fan axial direction DRa from the radially outer end 62*d* of the cover region 62*b* toward the ring inner peripheral end 621 in the fan radial direction DRr.

Therefore, the air, which is suctioned through the air suction port 62*a*, can flow from the ring inner peripheral end 621 of the shroud 62 along the radially outer end 62*d* of the cover region 62*b*. Thereby, it is possible to limit the generation of the noise when the air flows into the air flow passages 68.

Figure 21:
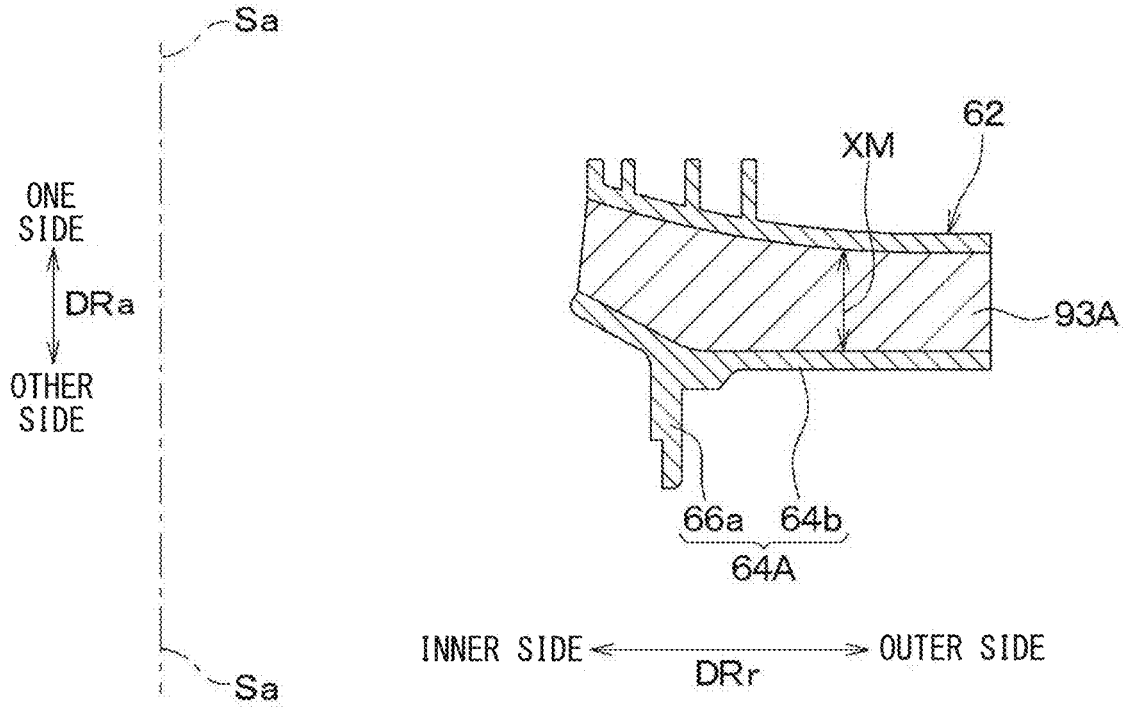
FIG. 21 is a cross-sectional view taken along a plane that includes a fan axis, indicating a right half of blades, an impeller cup, a shroud and a main plate of a comparative example of the first embodiment, which are located on a right side of the fan axis serving as a center line.

Here, as shown in FIG. 21, in a case of a comparative example where an impeller cup 66*a* and a main plate 64*b* are integrated together in one piece as an integral main plate 64A, a distance XM between the integral main plate 64A and the shroud 62 may possibly be progressively increased from the radially inner side toward the radially outer side in the fan radial direction DRr.

In this case, a slide die 93A, which is placed between the integral main plate 64A and the shroud 62, may not be slid and removed in the fan radial direction.

In contrast, according to the present embodiment, the shroud 62 is sloped to progressively approach the one axial side in the fan axial direction DRa from the radially outer end 62*d* of the cover region 62*b* toward the radially inner end 62*e* of the cover region 62*b* in the fan radial direction DRr.

In addition, the tangent line, which is perpendicular to the virtual line 230 (the virtual line 230 being perpendicular to the fan axial direction DRa and the fan radial direction DRr) and is tangent to the cover region 62*b*, is defined as the virtual tangent line 162*b*.

The cover region 62*b* and the slope surface 67 may be formed to implement that the slope surface 67 and the virtual tangent line 162*b* are parallel to each other. Alternatively, the cover region 62*b* and the slope surface 67 may be formed to implement that the distance ZL, which is measured between the slope surface 67 and the virtual tangent line 162*b* in the fan axial direction DRa, is progressively increased from the radially inner part to the radially outer part of the slope surface 67 in the fan radial direction DRr. Therefore, when the blades 60, the shroud 62 and the impeller cup 66 are integrally molded, the following advantages are achieved.

Specifically, at the time of forming each of the undercut regions 220 between the cover region 62*b* and the slope surface 67, each of the slide dies 93 can be removed from the location between the cover region 62*b* and the slope surface 67 toward the radially outer side in the fan radial direction DRr.

Thus, with this configuration, the generation of the noise is limited, and the shroud 62, the blades 60 and the impeller cup 66 can be integrally molded into one-piece using the slide dies 93 except the main plate 64.

According to the present embodiment constructed in the above-described manner, the following advantages (1) to (6) can be achieved.

(1) The slope surface 67 of the impeller cup 66 is sloped to progressively approach the other axial side in the fan axial direction DRa from the radially inner side toward the radially outer side in the fan radial direction DRr. Therefore, the air, which is suctioned through the air suction port 62*a*, can smoothly flow toward the radially outer side after passing through between the cover region 62*b* and the slope surface 67. Thereby, it is possible to limit the generation of the noise when the air flows into the air flow passages 68.

(2) The positive pressure surface 160*a* and the negative pressure surface 160*b* are formed such that the distance XR between the blades 60 is increased from the radially inner end 61*e* to the radially outer end 61*h*.

Therefore, each of the slide dies 93 can be easily removed from the location between the cover region 62*b* and the slope surface 67 toward the radially outer side in the fan radial direction DRr.

(3) In the present embodiment, the main plate 64 has the main plate outer peripheral surface 170 which is placed on the one axial side of the radially outer end 67*a* of the slope surface 67 in the fan axial direction DRa and extends in the circumferential direction Edr.

In order to overcome the restriction imposed on the use of the slide dies 93 and reduce the noise generated by the air flow, it is conceivable to form the air outlet 68*a* between an extension line 167*c* of the slope surface 67, which is extended toward the radially inner side in the fan radial direction DRr, and the virtual tangent line 162*b*, as shown in FIG. 15. In this case, the air outlet 68*a* is placed on the other axial side of the air suction port 62*a* in the fan axial direction DRa.

Specifically, in the case where the air outlet 68*a* is formed between the extension line 167*c* and the virtual tangent line 162*b*, the distance between the air suction port 62*a* and the air outlet 68*a* is increased in comparison to the present embodiment. Therefore, the size of the centrifugal blower 10 is increased.

However, at the centrifugal blower 10, the position of the air outlet 68*a* in the fan axial direction DRa has a high contribution to the performance. Therefore, the performance of the centrifugal blower 10 changes depending on the position of the air outlet 68*a* in the fan axial direction DRa. The performance of the centrifugal blower 10 includes noise performance, efficiency, etc.

In contrast, in the present embodiment, the main plate outer peripheral surface 170 of the main plate 64 is placed on the one axial side of the radially outer end 67*a* of the slope surface 67 in the fan axial direction DRa.

Therefore, at the same size as that of the previously proposed centrifugal blower, there is no need to change the position of the air outlet 68*a*, which has the high contribution to the performance of the centrifugal blower 10, in the fan axial direction DRa. Specifically, according to the present embodiment, the restriction imposed on the use of the slide dies 93 is satisfied, and the performance and the size of the centrifugal blower 10 can be the same as those of the previously proposed centrifugal blower.

(4) The main plate 64 has the main plate inner peripheral surface 171 that is placed between the main plate outer peripheral surface 170 and the slope surface 67 and extends in the circumferential direction Edr, and the main plate inner peripheral surface 171 is sloped to progressively approach the one axial side in the fan axial direction DRa from the radially inner side toward the radially outer side in the fan radial direction DRr.

Thereby, the air, which flows along the slope surface 67, can be smoothly guided to the main plate outer peripheral surface 170.

(5) In the cross-section of the slope surface 67 taken along the plane including the fan axis Sa, the acute angle, which is defined between the slope surface 67 and the virtual plane 210 (the virtual plane 210 being perpendicular to the fan axis Sa), is defined as the impeller slope angle θ.

The undercut region 220 of the air flow passage 68, which is located between the shroud 62 and the impeller cup 66, has the cross-sectional area along the plane including the fan axis Sa, and this cross-sectional area of the undercut region 220 is defined as the passage cross-sectional area.

The one circumferential location of the radially inner end 67*b* of the slope surface 67, which is adjacent to the positive pressure surface 160*a* of the blade 60*d*, is placed on the other axial side in the fan axial direction DRa relative to the other circumferential location of the radially inner end 67*b* of the slope surface 67, which is adjacent to the negative pressure surface 160*b* of the blade 60*c*.

The radially inner end 67*b* of the slope surface 67 is sloped to progressively approach the one axial side in the fan axial direction DRa from the one circumferential location, which is adjacent to the positive pressure surface 160*a* of the blade 60*d*, to the other circumferential location, which is adjacent to the negative pressure surface 160*b* of the blade 60*c*, toward the one circumferential side in the circumferential direction Edr.

Therefore, the impeller slope angle θ is progressively increased from the one circumferential location, which is adjacent to the positive pressure surface 160*a*, to the other circumferential location, which is adjacent to the negative pressure surface 160*b*, toward the one circumferential side in the circumferential direction Edr. Thereby, the passage cross-sectional area of the undercut region 220 is progressively decreased from the one circumferential location, which is adjacent to the positive pressure surface 160*a*, to the other circumferential location, which is adjacent to the negative pressure surface 160*b*, toward the one circumferential side in the circumferential direction Edr.

Thus, at the undercut region 220, the velocity of the air flow, which flows at the one circumferential location adjacent to the positive pressure surface 160*a*, can be decreased, and the velocity of the air flow, which flows at the other circumferential location adjacent to the negative pressure surface 160*b*, can be increased.

As a result, at the undercut region 220, it is possible to decrease the difference between the velocity of the air flow, which flows at the one circumferential location adjacent to the positive pressure surface 160*a*, and the velocity of the air flow, which flows at the other circumferential location adjacent to the negative pressure surface 160*b*.

Here, in a case where the difference exists between the velocity of the air flow, which flows at the one circumferential location adjacent to the positive pressure surface 160*a*, and the velocity of the air flow, which flows at the other circumferential location adjacent to the negative pressure surface 160*b*, at the undercut region 220, noise may possibly be generated by the friction generated between these air flows.

In contrast, in the present embodiment, as described above, the velocity difference between these air flows can be decreased. Thereby, the generation of the noise caused by the velocity difference can be decreased.

(6) In the present embodiment, the gaps 200, 201, 202 in the labyrinth form are formed between the radially inner part of the main plate 64, which faces the radially inner side in the fan radial direction DRr, and the radially outer part of the impeller cup 66, which faces the radially outer side in the fan radial direction DRr. Thereby, the labyrinth structure is formed between the radially inner part of the main plate 64, which faces the radially inner side in the fan radial direction DRr, and the radially outer part of the impeller cup 66, which faces the radially outer side in the fan radial direction DRr. As a result, it is possible to limit a flow of the air in the gap between the radially inner part of the main plate 64, which faces the radially inner side in the fan radial direction DRr, and the radially outer part of the impeller cup 66, which faces the radially outer side in the fan radial direction DRr.

Second Embodiment

With respect to the centrifugal blower 10 of the second embodiment, with reference to FIGS. 22, 23 and 24, there will be described an example, in which a slope angle of the main plate inner peripheral surface 171 is changed at the centrifugal blower 10 of the first embodiment.

Figure 22:
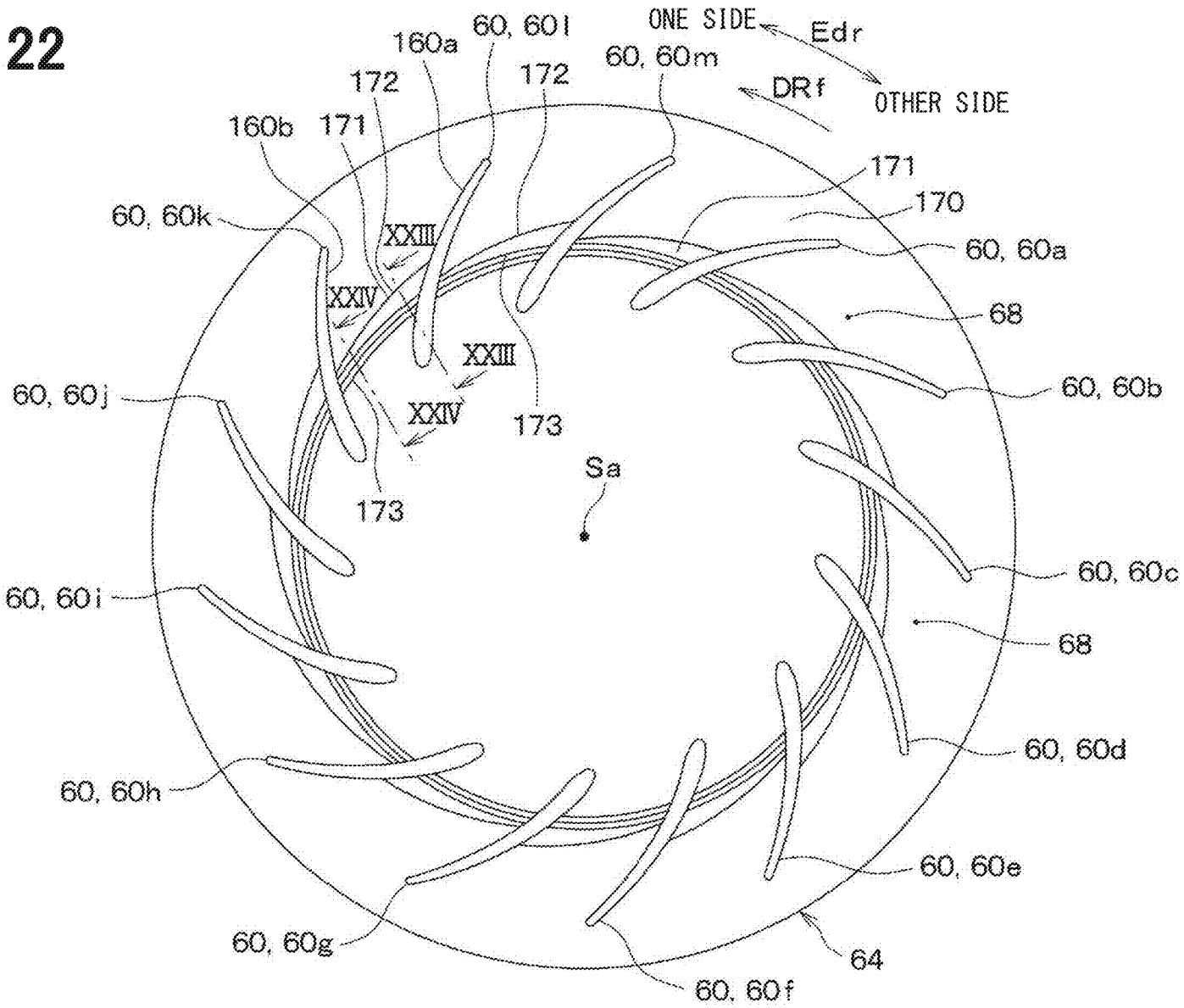
FIG. 22 is a view of a main plate and blades seen from the one axial side in the fan axial direction according to a second embodiment.

FIG. 22 is a view of the main plate 64 and the blades 60 seen from the one axial side in the fan axial direction DRa. FIG. 23 is a cross-sectional view taken along line XXIII-XXIII in FIG. 22, and FIG. 24 is a cross-sectional view taken along line XXIV-XXIV in FIG. 22. In FIG. 22, indication of a cross-sectional hatching of each of the blades 60 is omitted for clarity of illustration.

In the present embodiment, in a cross-section of the main plate inner peripheral surface 171 of the main plate 64 taken along a plane including the fan axis Sa, an acute angle, which is defined between the main plate inner peripheral surface 171 and a virtual plane 240 (the virtual plane 240 being perpendicular to the fan axis Sa), is defined as a main plate slope angle θa. Here, the acute angle is defined as an angle θa that is a smaller angle between two angles θa, βa defined between the main plate inner peripheral surface 171 and the virtual plane 240.

Figure 23:
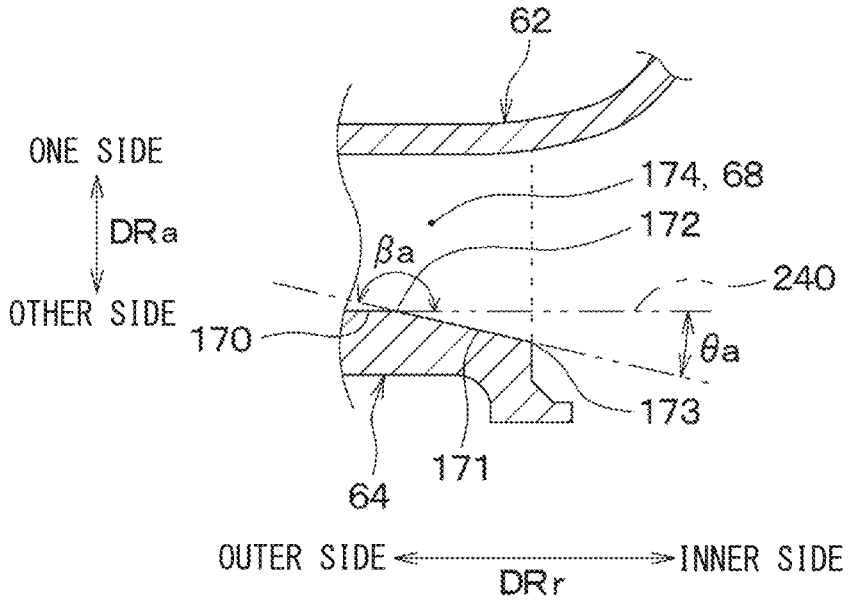
FIG. 23 is a cross-sectional view taken along line XXIII-XXIII in FIG. 22 for assisting explanation of a main plate slope angle of a portion of a main plate inner peripheral surface of the main plate at a location adjacent to a positive pressure surface of one of the blades and explanation of a region between the shroud and the main plate according to the second embodiment.
Figure 24:
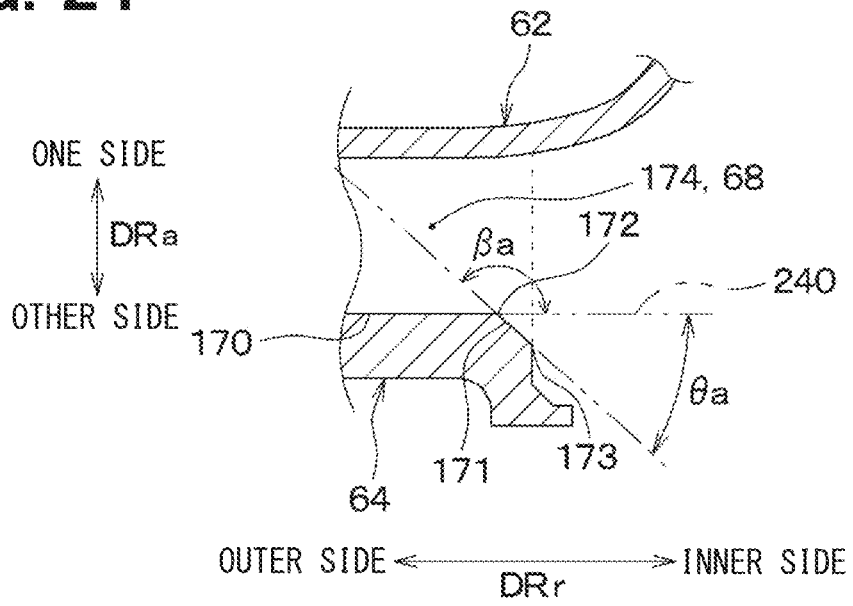
FIG. 24 is a cross-sectional view taken along line XXIV-XXIV in FIG. 22 for assisting explanation of a main plate slope angle of a portion of the main plate inner peripheral surface of the main plate at a location adjacent to a negative pressure surface of one of the blades and explanation of a region between the shroud and the main plate according to the second embodiment.

As shown in FIGS. 23 and 24, a region 174 of the air flow passage 68, which is located between the shroud 62 and the main plate 64, has a cross-sectional area along the plane including the fan axis Sa, and this cross-sectional area of the region 174 is defined as a passage cross-sectional area.

The main plate slope angle θa in FIG. 23 is a main plate slope angle at one circumferential location, which is adjacent to the positive pressure surface 160*a* of the blade 60*l*, along the main plate inner peripheral surface 171 of the main plate 64 in the circumferential direction Edr. The main plate slope angle θa in FIG. 24 is a main plate slope angle at another circumferential location, which is adjacent to the negative pressure surface 160*b* of the blade 60*k*, along the main plate inner peripheral surface 171 of the main plate 64 in the circumferential direction Edr.

In the present embodiment, as described above, the positive pressure surface 160*a* and the negative pressure surface 160*b* of each of the blades 60 are placed to overlap with the main plate inner peripheral surface 171 of the main plate 64 in the fan axial direction DRa.

A radially inner end (also referred to as an inner peripheral end or an inner peripheral edge) 173 of the main plate inner peripheral surface 171, which faces the radially inner side in the fan radial direction DRr, is placed at the same axial position in the fan axial direction DRa along the entire circumferential extent of the radially inner end 173 in the circumferential direction Edr. The radially inner end 173 of the main plate inner peripheral surface 171, which faces the radially inner side in the fan radial direction DRr, is placed at the same radial position in the fan radial direction DRr along the entire circumferential extent of the radially inner end 173 in the circumferential direction Edr.

A radially outer end (also referred to as an outer peripheral end or an outer peripheral edge) 172 of the main plate inner peripheral surface 171, which faces the radially outer side in the fan radial direction DRr, is placed at the same axial position in the fan axial direction DRa along the entire circumferential extent of the radially outer end 172 in the circumferential direction Edr. A radial position of the radially outer end 172 of the main plate inner peripheral surface 171, which faces the radially outer side in the fan radial direction DRr, progressively approaches the radially outer side in the fan radial direction DRr from the other circumferential location, which is adjacent to the negative pressure surface 160*b*, to the one circumferential location, which is adjacent to the positive pressure surface 160*a*, in the circumferential direction Edr.

Here, the main plate slope angle θa is progressively increased from the one circumferential location, which is adjacent to the positive pressure surface 160*a* of the blade 60*l*, to the other circumferential location, which is adjacent to the negative pressure surface 160*b* of the blade 60*k*, toward the one circumferential side in the circumferential direction Edr. Thereby, the passage cross-sectional area of the region 174 is progressively decreased from the one circumferential location, which is adjacent to the positive pressure surface 160*a*, to the other circumferential location, which is adjacent to the negative pressure surface 160*b*, toward the one circumferential side in the circumferential direction Edr. The structure of the main plate 64, which has the main plate slope angle θa described above, is equally formed between each adjacent two of the blades 60 which are other than the blades 60*l*, 60*k*.

According to the present embodiment described above, in the centrifugal blower 10, the main plate slope angle θa of the main plate 64 is progressively increased from the one circumferential location, which is adjacent to the positive pressure surface 160*a*, to the other circumferential location, which is adjacent to the negative pressure surface 160*b*, toward the one circumferential side in the circumferential direction Edr.

Thereby, the passage cross-sectional area of the region 174 is progressively decreased from the one circumferential location, which is adjacent to the positive pressure surface 160*a*, to the other circumferential location, which is adjacent to the negative pressure surface 160*b*, toward the one circumferential side in the circumferential direction Edr. Thus, at the region 174, the velocity of the air flow, which flows at the one circumferential location adjacent to the positive pressure surface 160*a*, can be decreased, and the velocity of the air flow, which flows at the other circumferential location adjacent to the negative pressure surface 160*b*, can be increased.

As a result, at the region 174, it is possible to decrease the difference between the velocity of the air flow, which flows at the one circumferential location adjacent to the positive pressure surface 160*a*, and the velocity of the air flow, which flows at the other circumferential location adjacent to the negative pressure surface 160*b*. Thereby, the generation of the noise caused by this difference can be decreased.

Third Embodiment

Figure 25:
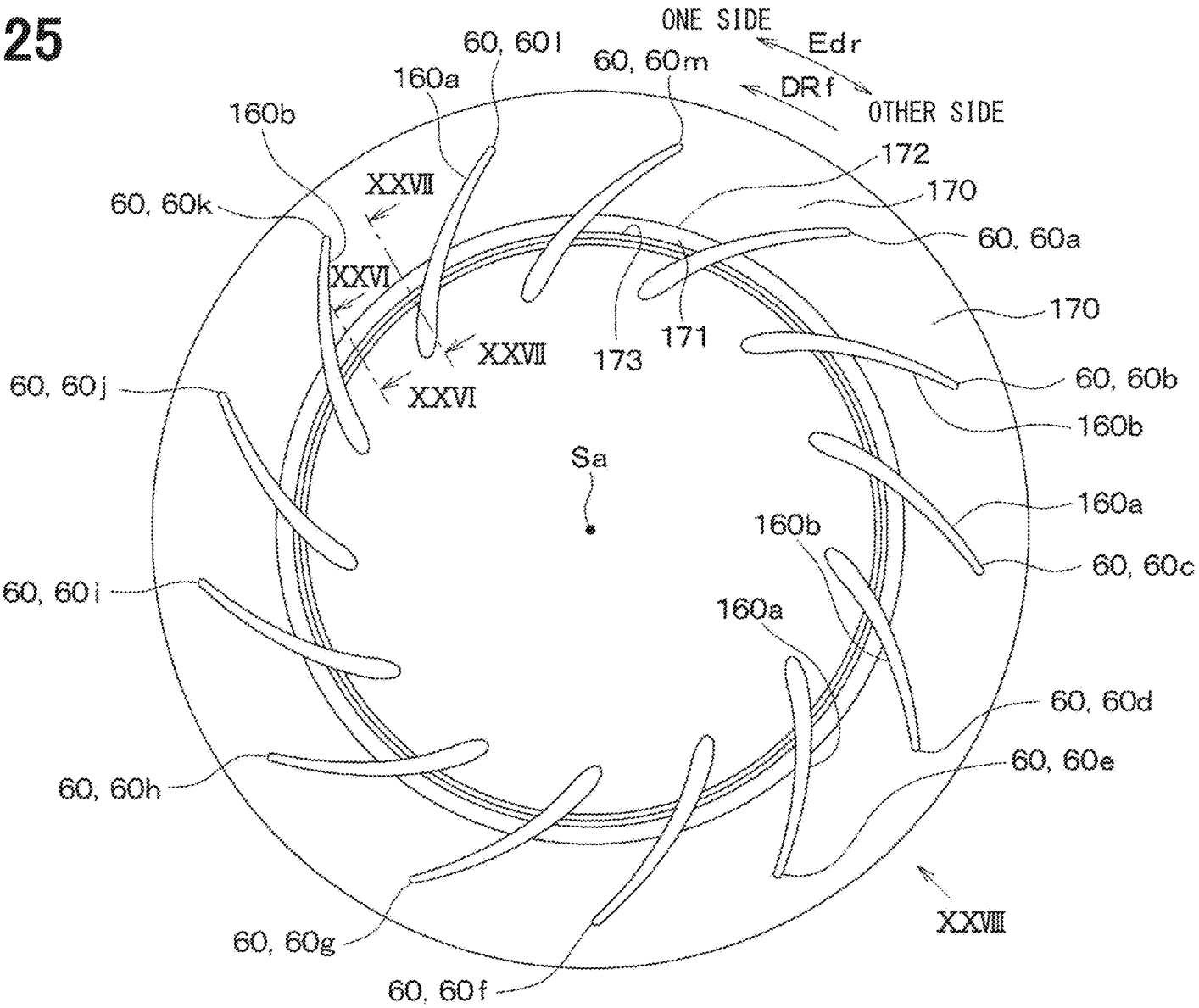
FIG. 25 is a view of a main plate and blades seen from the one axial side in the fan axial direction according to a third embodiment.
Figure 26:
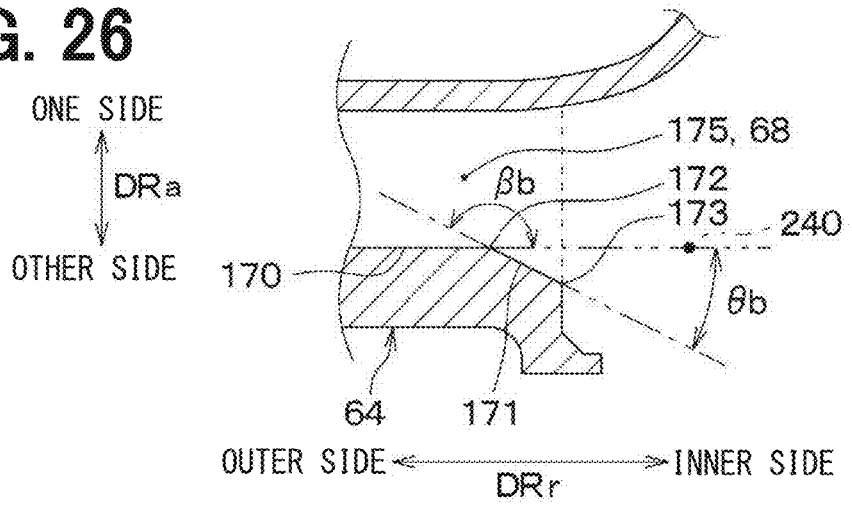
FIG. 26 is a cross-sectional view taken along line XXVI-XXVI in FIG. 25 for assisting explanation of a main plate slope angle of a portion of a main plate inner peripheral surface of the main plate at a location adjacent to a negative pressure surface of one of the blades and explanation of a region between the shroud and a main plate outer peripheral surface of the main plate according to the third embodiment.
Figure 27:
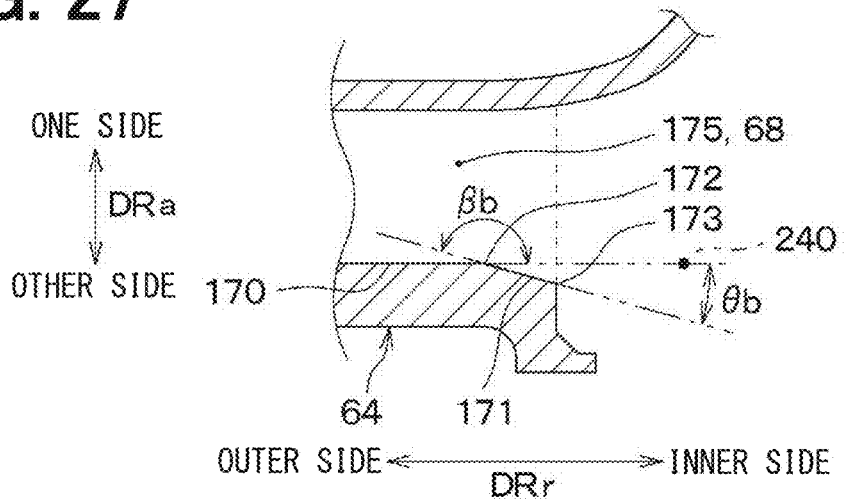
FIG. 27 is a cross-sectional view taken along line XXVII-XXVII in FIG. 25 for assisting explanation of a main plate slope angle of a portion of the main plate inner peripheral surface of the main plate at a location adjacent to a positive pressure surface of one of the blades and explanation of a region between the shroud and the main plate outer peripheral surface of the main plate according to the third embodiment.

In the second embodiment, there is described the example where the passage cross-sectional area of the region 174 between the shroud 62 and the main plate 64 varies in the circumferential direction Edr. With reference to FIGS. 25, 26 and 27, there will be described the present embodiment where a passage cross-sectional area of a region 175 between the shroud 62 and the main plate outer peripheral surface 170 of the main plate 64 varies in the circumferential direction Edr. In FIG. 25, indication of a cross-sectional hatching of each of the blades 60 is omitted for clarity of illustration.

Figure 28:
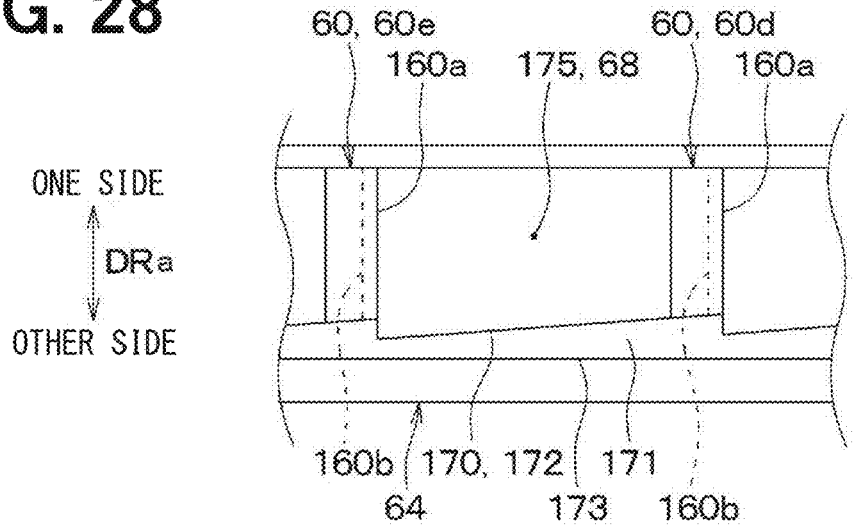
FIG. 28 is a view taken in a direction of an arrow XXVIII in FIG. 25 for assisting explanation of a region between the main plate outer peripheral surface and the main plate inner peripheral surface of the main plate according to the third embodiment.

FIG. 25 is a view of the main plate 64 and the blades 60 seen from the one axial side in the fan axial direction DRa. FIG. 26 is a cross-sectional view taken along line XXVI-XXVI in FIG. 25, and FIG. 27 is a cross-sectional view taken along line XXVII-XXVII in FIG. 25. FIG. 28 is a view in a direction of an arrow XXVIII in FIG. 25.

In the present embodiment, in a cross-section of the main plate 64 taken along a plane including the fan axis Sa, an acute angle, which is defined between the main plate inner peripheral surface 171 and the virtual plane 240 (the virtual plane 240 being perpendicular to the fan axis Sa), is defined as a main plate slope angle θb. Here, the acute angle is defined as an angle θb that is a smaller angle between two angles θb, βb defined between the main plate inner peripheral surface 171 and the virtual plane 240.

As shown in FIGS. 26 and 27, the region 175 of the air flow passage 68, which is located between the shroud 62 and the main plate outer peripheral surface 170 of the main plate 64, has a cross-sectional area along the plane including the fan axis Sa, and this cross-sectional area of the region 175 is defined as a passage cross-sectional area.

The main plate slope angle θb in FIG. 26 is a main plate slope angle at the other circumferential location, which is adjacent to the negative pressure surface 160*b* of the blade 60*k*, along the main plate inner peripheral surface 171 of the main plate 64 in the circumferential direction Edr. The main plate slope angle θb in FIG. 27 is a main plate slope angle at the one circumferential location, which is adjacent to the positive pressure surface 160*a* of the blade 60*l*, along the main plate inner peripheral surface 171 of the main plate 64 in the circumferential direction Edr.

In the present embodiment, as described above, the positive pressure surface 160*a* and the negative pressure surface 160*b* of each of the blades 60 are placed to overlap with the main plate inner peripheral surface 171 and the main plate outer peripheral surface 170 of the main plate 64 in the fan axial direction DRa.

The radially inner end 173 of the main plate inner peripheral surface 171, which faces the radially inner side in the fan radial direction DRr, is placed at the same axial position in the fan axial direction DRa along the entire circumferential extent of the radially inner end 173 in the circumferential direction Edr. The radially inner end 173 of the main plate inner peripheral surface 171, which faces the radially inner side in the fan radial direction DRr, is placed at the same radial position in the fan radial direction DRr along the entire circumferential extent of the radially inner end 173 in the circumferential direction Edr.

As shown in FIG. 28, the radially outer end 172 of the main plate inner peripheral surface 171, which faces the radially outer side in the fan radial direction DRr, progressively approaches the one axial side in the fan axial direction DRa from the one circumferential location, which is adjacent to the positive pressure surface 160*a*, to the other circumferential location, which is adjacent to the negative pressure surface 160*b*, in the circumferential direction Edr. The radially outer end 172 of the main plate inner peripheral surface 171, which faces the radially outer side in the fan radial direction DRr, is placed at the same radial position in the fan radial direction DRr along the entire circumferential extent of the radially outer end 172 in the circumferential direction Edr. The main plate slope angle θb is progressively decreased from the one circumferential location, which is adjacent to the positive pressure surface 160*a* of the blade 60*l*, to the other circumferential location, which is adjacent to the negative pressure surface 160*b* of the blade 60*k*, toward the one circumferential side in the circumferential direction Edr.

The main plate outer peripheral surface 170 is sloped to progressively approach the one axial side in the fan axial direction DRa from the one circumferential location, which is adjacent to the positive pressure surface 160*a* of the blade 60*l*, to the other circumferential location, which is adjacent to the negative pressure surface 160*b* of the blade 60*k*, toward the one circumferential side in the circumferential direction Edr. Thereby, the passage cross-sectional area of the region 175 is progressively decreased from the one circumferential location, which is adjacent to the positive pressure surface 160*a* of the blade 60*l*, to the other circumferential location, which is adjacent to the negative pressure surface 160*b* of the blade 60*k*, toward the one circumferential side in the circumferential direction Edr.

The structure of the main plate 64, which has the passage cross-sectional area of the region 175 described above, is equally formed between each adjacent two of the blades 60 which are other than the blades 60*l*, 60*k*.

According to the present embodiment described above, the main plate 64 of the centrifugal blower 10 is formed such that the main plate outer peripheral surface 170 of the main plate 64 is sloped to progressively approach the one axial side in the fan axial direction DRa from the one circumferential location, which is adjacent to the positive pressure surface 160*a*, to the other circumferential location, which is adjacent to the negative pressure surface 160*b*, toward the one circumferential side in the circumferential direction Edr. Thereby, the passage cross-sectional area of the region 175 is progressively decreased from the one circumferential location, which is adjacent to the positive pressure surface 160*a*, to the other circumferential location, which is adjacent to the negative pressure surface 160*b*, toward the one circumferential side in the circumferential direction Edr.

Thus, at the region 175, the velocity of the air flow, which flows at the one circumferential location adjacent to the positive pressure surface 160*a*, can be decreased, and the velocity of the air flow, which flows at the other circumferential location adjacent to the negative pressure surface 160*b*, can be increased. As a result, at the region 175, it is possible to decrease the difference between the velocity of the air flow, which flows at the one circumferential location adjacent to the positive pressure surface 160*a*, and the velocity of the air flow, which flows at the other circumferential location adjacent to the negative pressure surface 160*b*. Thereby, the generation of the noise caused by the velocity difference can be decreased.

Other Embodiments (1) In the first to third embodiments, there is described the example where the main plate 64 and the impeller cup 66 are fitted with each other in order to implement that the impeller cup 66 is coupled to the main plate 64 in a manner that limits the movement of the impeller cup 66 relative to the main plate 64. Alternatively, this configuration may be modified as described in the following sections (a) and (b).

(a) The main plate 64 and the impeller cup 66 may be joined together by a bonding agent in order to implement that the impeller cup 66 is coupled to the main plate 64 in the manner that limits the movement of the impeller cup 66 relative to the main plate 64.

Figure 32:
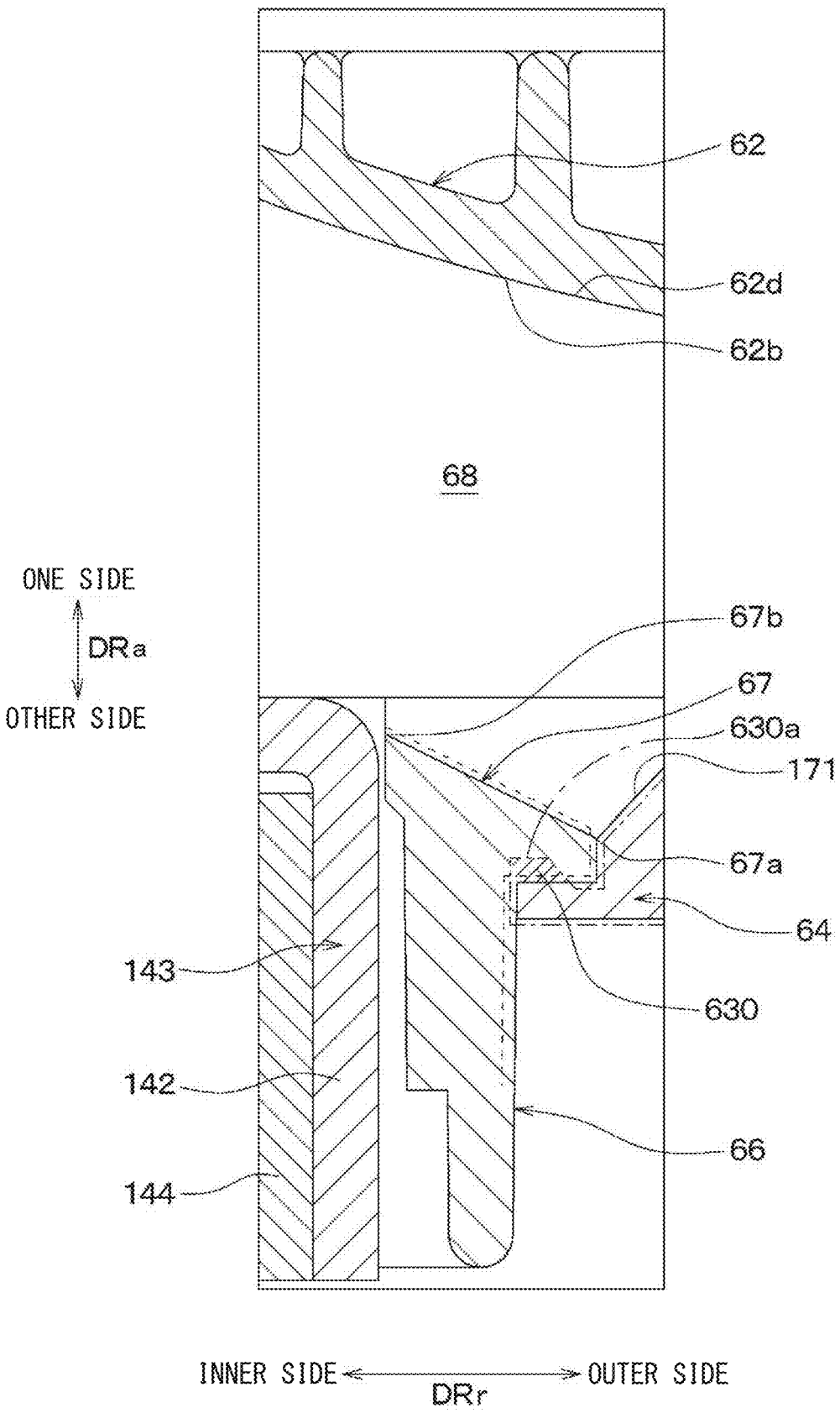
FIG. 32 is a partial enlarged cross-sectional view of a portion including a cover region of a shroud and a slope surface of an impeller cup of another embodiment, corresponding to FIG. 5 of the first embodiment.
Figure 33:
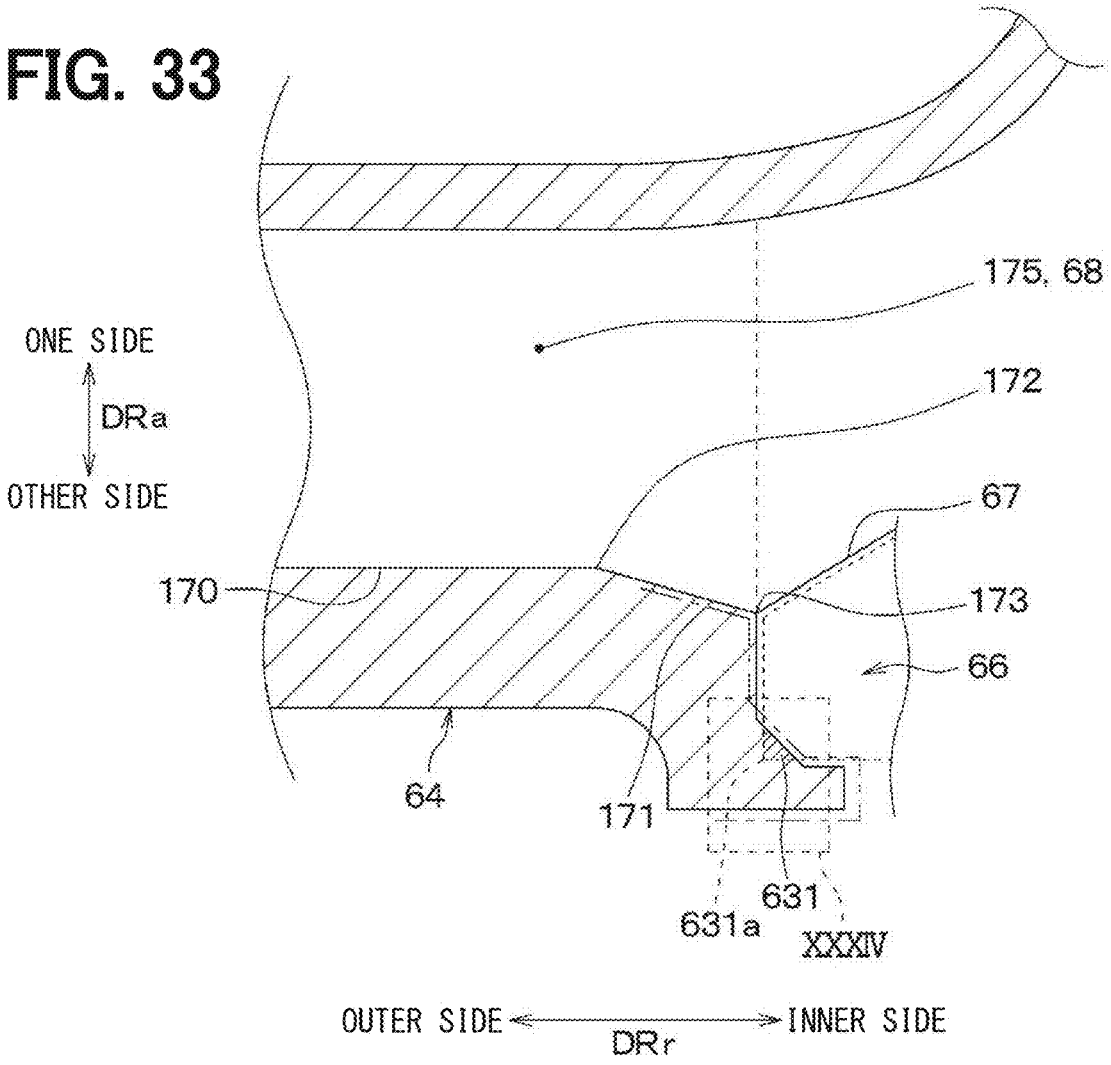
FIG. 33 is a partial enlarged cross-sectional view of a portion including a radially inner portion of a main plate and a radially outer portion of an impeller cup of another embodiment, corresponding to FIG. 26 of the first embodiment.
Figure 34:
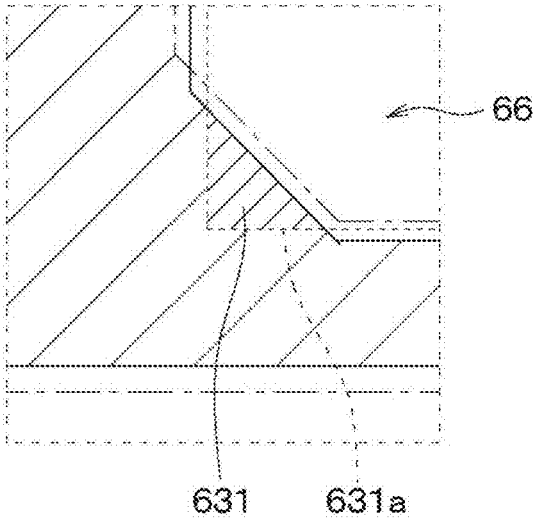
FIG. 34 is a partial enlarged view of a portion XXXIV in FIG. 32 according to the other embodiment.

(b) As shown in FIGS. 32, 33 and 34, the main plate 64 and the impeller cup 66 may be joined together by welding (fusing) in order to implement that the impeller cup 66 is coupled to the main plate 64 in the manner that limits the movement of the impeller cup 66 relative to the main plate 64.

In the specific example shown in FIG. 32, the main plate 64 is welded and is joined to the impeller cup 66 through a joint 630 at a location of the main plate 64 that is placed on the radially inner side in the fan radial direction DRr and the one axial side in the fan axial direction DRa. FIG. 32 is a partial enlarged cross-sectional view of a portion that includes the main plate inner peripheral surface 171 of the main plate 64 and the slope surface 67 of the impeller cup 66.

In this case, as indicated by a dot-dash line in FIG. 32, a projection 630*a*, which projects toward the one axial side in the fan axial direction DRa, is formed at the radially inner part of the main plate 64, which faces the radially inner side in the fan radial direction DRr, before the time of welding.

In contrast, before the time of welding, in a state where the main plate 64 is fitted to the impeller cup 66, the radially outer part of the impeller cup 66, which faces the radially outer side in the fan radial direction DRr, interferes with the projection 630*a* of the main plate 64, as indicated by a dotted line in FIG. 32. Then, the radially outer part of the impeller cup 66, which faces the radially outer side in the fan radial direction DRr, is welded and is joined to the projection 603*a* of the main plate 64 to form the joint 630.

In the specific example shown in FIGS. 33 and 34, the main plate 64 is welded and is joined to the impeller cup 66 through a joint 631 at a location of the main plate 64 that is the radially inner side in the fan radial direction DRr and the one axial side in the fan axial direction DRa. FIG. 33 is a partial enlarged cross-sectional view of a portion, which includes the radially inner part of the main plate 64, which faces the radially inner side in the fan radial direction DRr, and the radially outer part of the impeller cup 66, which faces the radially outer side in the fan radial direction DRr. FIG. 34 is a partial enlarged view of a portion XXXIV in FIG. 33.

In this case, before the time of welding, as indicated by a dotted line in FIGS. 33 and 34, a projection 631*a*, which projects toward the other axial side in the fan axial direction DRa, is formed at the radially outer part of the impeller cup 66, which faces the radially outer side in the fan radial direction DRr.

Before the time of welding, in the state where the main plate 64 is fitted to the impeller cup 66, the radially inner part of the main plate 64, which faces the radially inner side in the fan radial direction DRr, interferes with the projection 631*a* of the impeller cup 66, as indicated by a dot-dash line in FIGS. 33 and 34.

Then, the projection 631*a* of the impeller cup 66 is welded and is joined to the main plate 64, and thereby, the joint 631 is formed.

(2) In the first to third embodiments, there is described the example where the main plate 64 has the main plate outer peripheral surface 170 and the main plate inner peripheral surface 171. Alternatively, the configuration of the main plate 64 may be modified as described in the following sections (c), (d) and (e).

Figure 29:
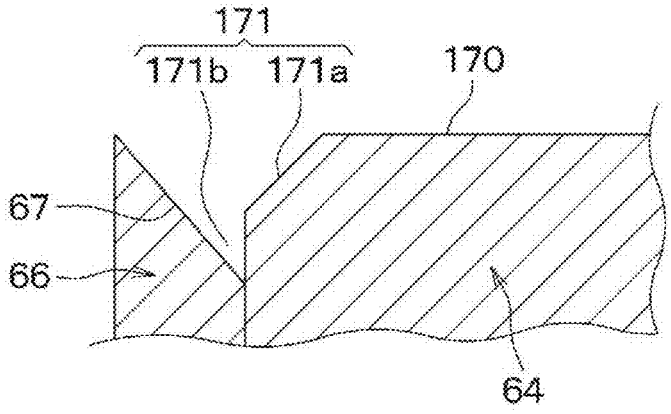
FIG. 29 is a partial enlarged cross-sectional view of an impeller cup and a main plate of a centrifugal blower of another embodiment for assisting explanation of a main plate inner peripheral surface of a main plate.

(c) As shown in FIG. 29, the main plate 64 has the main plate outer peripheral surface 170 and the main plate inner peripheral surface 171. The main plate inner peripheral surface 171 has a main plate slope surface 171*a* and a main plate perpendicular surface 171*b*.

The main plate slope surface 171*a* is sloped to progressively approach the one axial side in the fan axial direction DRa from the radially inner side toward the radially outer side in the fan radial direction DRr. The main plate slope surface 171*a* extends in the circumferential direction Edr.

The main plate perpendicular surface 171*b* is placed on the other axial side of the main plate slope surface 171*a* in the fan axial direction DRa. The main plate perpendicular surface 171*b* extends in the fan axial direction DRa. The main plate perpendicular surface 171*b* extends in the circumferential direction Edr.

Figure 30:
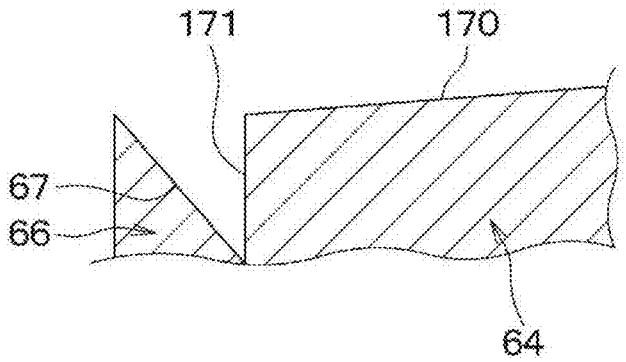
FIG. 30 is a partial enlarged cross-sectional view of an impeller cup and a main plate of a centrifugal blower of another embodiment for assisting explanation of a main plate outer peripheral surface of a main plate.

(d) As shown in FIG. 30, the main plate 64 has the main plate outer peripheral surface 170 and the main plate inner peripheral surface 171. The main plate outer peripheral surface 170 is sloped to progressively approach the one axial side in the fan axial direction DRa from the radially inner side toward the radially outer side in the fan radial direction DRr. The main plate inner peripheral surface 171 extends in the fan axial direction DRa.

Figure 31:
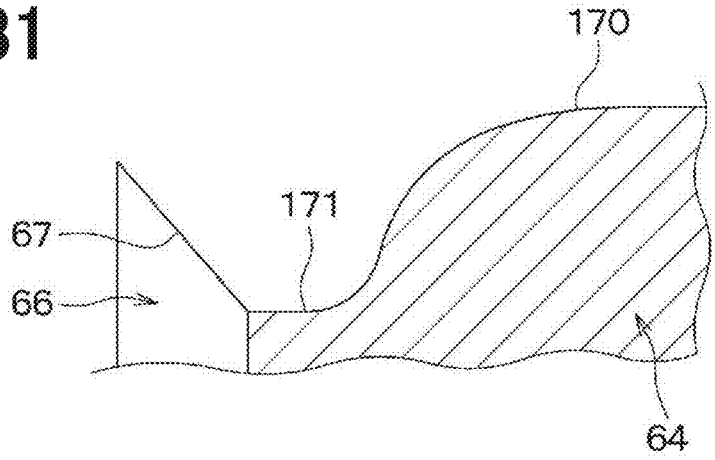
FIG. 31 is a partial enlarged cross-sectional view of an impeller cup and a main plate of a centrifugal blower of another embodiment for assisting explanation of a main plate outer peripheral surface and a main plate inner peripheral surface of a main plate.

(e) As shown in FIG. 31, the main plate 64 has the main plate outer peripheral surface 170 and the main plate inner peripheral surface 171. The main plate outer peripheral surface 170 is sloped in a curve to smoothly approach the one axial side in the fan axial direction DRa from the radially inner side toward the radially outer side in the fan radial direction DRr. The main plate inner peripheral surface 171 is sloped in a curve to smoothly approach the one axial side in the fan axial direction DRa from the radially inner side toward the radially outer side in the fan radial direction DRr.

(3) In the first, second and third embodiments, there is described the example where the blades 60, the shroud 62 and the impeller cup 66 are integrally molded in one-piece from the resin material. Alternatively, the blades 60, the shroud 62 and the impeller cup 66 may be formed integrally in one-piece from another material, such as a metal material, which is other than the resin material.

(4) In the first to third embodiments, there is described the example where the two outer peripheral surfaces 190, 191 are formed at the radially outer part of the impeller cup 66, which faces the radially outer side in the fan radial direction DRr.

However, the present disclosure is not limited to this configuration, and three or more outer peripheral surfaces may be formed at the radially outer part of the impeller cup 66, which faces the radially outer side in the fan radial direction DRr, as long as the labyrinth structure is formed between the radially inner part of the main plate 64, which faces the radially inner side in the fan radial direction DRr, and the radially outer part of the impeller cup 66, which faces the radially outer side in the fan radial direction DRr.

In this case, three or more inner peripheral surfaces are formed at the radially inner part of the main plate 64, which faces the radially inner side in the fan radial direction DRr.

(5) In the first to third embodiments, there is described the example where the end surface of the impeller cup 66, which faces the one axial side in the fan axial direction DRa, is the slope surface 67. The slope surface 67 is the end surface that is sloped to progressively approach the other axial side in the fan axial direction DRa from the radially inner side toward the radially outer side in the fan radial direction DRr.

Alternatively, the end surface of the impeller cup 66, which faces the one axial side in the fan axial direction DRa, may be a planar surface that is perpendicular to the fan axial direction DRa.

(6) In the first to third embodiments, there is described the example where the cover region 62*b* is shaped in the convex arcuate form, which is convex toward the other axial side in the fan axial direction DRa. However, the present disclosure is not limited, and the shape of the cover region 62*b* may be another curve form.

(7) The present disclosure is not limited to the above-described embodiments, and each of the above-described embodiments may be changed as appropriate within the scope of the present disclosure. Further, the above embodiments are not unrelated to each other and can be appropriately combined unless the combination is clearly impossible. Needless to say, in each of the embodiments described above, the elements of the embodiment are not necessarily essential except when it is clearly indicated that they are essential and when they are clearly considered to be essential in principle.

In the embodiments configured in the above described manner may be configured as follows. Specifically, in the centrifugal blower, the electric motor includes the rotor that is placed on the radially inner side of the tubular portion (the impeller cup) at the opening and is supported by the tubular portion, and the rotor is configured to provide the rotational force to the tubular portion.

The rotor is shaped in a tubular form centered on the axis and covers the tubular portion and a hollow space of the tubular portion from the one axial side in the fan axial direction. The rotor includes a cover portion which is sloped to progressively approach the other axial side in the fan axial direction from the radially inner side toward the radially outer side in the radial direction, and the cover portion guides the air, which is suctioned into the suction port, to the air flow passages.

What is claimed is:

1. A centrifugal blower comprising:

a plurality of blades that are arranged in a circumferential direction about a central axis;

a shroud that is shaped in a ring form centered on the central axis and covers the plurality of blades from one axial side in an axial direction of the central axis, wherein the shroud forms a suction port that is located on an inner side of the shroud in a radial direction of the central axis and opens in the axial direction;

a main plate that is shaped in a ring form centered on the central axis and covers the plurality of blades from another axial side which is opposite to the one axial side in the axial direction, wherein the main plate forms an opening that opens in the axial direction and is located on an inner side of the main plate in the radial direction; and a tubular portion that is placed in the opening and is shaped in a cylindrical tubular form centered on the central axis, wherein the tubular portion is configured to be rotated about the central axis by a rotational force of an electric motor, wherein:

the plurality of blades, the shroud and the tubular portion are integrally formed in one-piece as an integrated component;

an air flow passage is formed between each adjacent two of the plurality of blades at an axial location that is between:

the tubular portion and the main plate; and the shroud;

the tubular portion is coupled to the main plate in a manner that limits relative movement of the tubular portion relative to the main plate;

when the plurality of blades, the shroud, the tubular portion and the main plate are rotated toward one circumferential side in the circumferential direction by the rotational force of the electric motor, air, which is suctioned from the one axial side into the suction port in the axial direction, is conducted through the air flow passage formed between each adjacent two of the plurality of blades and is discharged toward a radially outer side in the radial direction;

the shroud has a cover region, which faces the another axial side in the axial direction and is configured to cover a side of the tubular portion which faces the one axial side in the axial direction, wherein in a cross-section of the shroud which is taken along a plane that includes the central axis, the cover region is shaped in a convex arcuate form that is convex toward the another axial side in the axial direction;

the cover region of the shroud is sloped to progressively approach the one axial side in the axial direction from a radially outer end of the cover region toward a radially inner end of the shroud in the radial direction;

an axial end part of the tubular portion, which faces the one axial side in the axial direction, has an end surface; and a line, which is perpendicular to the axial direction and is also perpendicular to the radial direction, is defined as a first virtual line, and a tangent line, which is perpendicular to the first virtual line and is tangent to the cover region, is defined as a second virtual line, and the cover region and the end surface are formed to implement that the end surface of the tubular portion and the second virtual line are parallel to each other, or a distance, which is measured between the end surface and the second virtual line in the axial direction, is progressively increased from a radially inner part of the end surface to a radially outer part of the end surface.

2. The centrifugal blower according to claim 1, wherein the end surface of the tubular portion is a slope surface that is sloped to progressively approach the one axial side in the axial direction from the radially outer part of the end surface to the radially inner part of the end surface.

3. The centrifugal blower according to claim 2, wherein the main plate has a main plate flow passage surface that is placed on the one axial side in the axial direction relative to a radially outer end of the slope surface, and the main plate flow passage surface circumferentially extends in the circumferential direction.

4. The centrifugal blower according to claim 3, wherein the main plate has an inner peripheral slope surface that is radially placed between the main plate flow passage surface and the slope surface of the tubular portion and circumferentially extends in the circumferential direction, and the inner peripheral slope surface is sloped to progressively approach the one axial side in the axial direction from a radially inner part of the inner peripheral slope surface to a radially outer part of the inner peripheral slope surface.

5. The centrifugal blower according to claim 2, wherein:

each adjacent two of the plurality of blades are defined as a one-side blade and an other-side blade, respectively, and the other-side blade, which is placed on another circumferential side in the circumferential direction relative to the one-side blade, has a positive pressure surface, which faces the one circumferential side in the circumferential direction and receives a positive pressure when the plurality of blades are rotated toward the one circumferential side in the circumferential direction;

among each adjacent two of the plurality of blades, the one-side blade, which is placed on the one circumferential side in the circumferential direction relative to the other-side blade, has a negative pressure surface, which faces the another circumferential side in the circumferential direction and receives a negative pressure when the plurality of blades are rotated toward the one circumferential side in the circumferential direction;

an acute angle, which is defined between the slope surface and a virtual plane perpendicular to the axial direction, is defined as an impeller slope angle;

at each adjacent two of the plurality of blades, a region of the air flow passage, which is located between the shroud and the tubular portion, has a cross-sectional area that is taken along a plane including the central axis and is defined as a passage cross-sectional area; and the impeller slope angle is progressively increased from one circumferential location, which is adjacent to the positive pressure surface of the other-side blade, to another circumferential location, which is adjacent to the negative pressure surface of the one-side blade, toward the one circumferential side in the circumferential direction, and thereby, the passage cross-sectional area is progressively decreased from the one circumferential location, which is adjacent to the positive pressure surface of the other-side blade, to the another circumferential location, which is adjacent to the negative pressure surface of the one-side blade, toward the one circumferential side in the circumferential direction.

6. The centrifugal blower according to claim 5, wherein:

one circumferential location of a radially inner end of the slope surface, which is adjacent to the positive pressure surface of the other-side blade, is placed on the another axial side in the axial direction relative to another circumferential location of the radially inner end of the slope surface, which is adjacent to the negative pressure surface of the one-side blade; and the radially inner end of the slope surface is sloped to progressively approach the one axial side in the axial direction from the one circumferential location, which is adjacent to the positive pressure surface of the other-side blade, to the another circumferential location, which is adjacent to the negative pressure surface of the one-side blade, toward the one circumferential side in the circumferential direction.

7. The centrifugal blower according to claim 4, wherein:

each adjacent two of the plurality of blades are defined as a one-side blade and an other-side blade, respectively, and the other-side blade, which is placed on another circumferential side in the circumferential direction relative to the one-side blade, has a positive pressure surface, which faces the one circumferential side in the circumferential direction and receives a positive pressure when the plurality of blades are rotated toward the one circumferential side in the circumferential direction;

among each adjacent two of the plurality of blades, the one-side blade, which is placed on the one circumferential side in the circumferential direction relative to the other-side blade, has a negative pressure surface, which faces the another circumferential side in the circumferential direction and receives a negative pressure when the plurality of blades are rotated toward the one circumferential side in the circumferential direction;

the positive pressure surface of the other-side blade and the negative pressure surface of the one-side blade respectively overlap with the inner peripheral slope surface of the main plate in the axial direction;

an acute angle, which is defined between the inner peripheral slope surface and a virtual plane perpendicular to the axial direction, is defined as a main plate slope angle;

at each adjacent two of the plurality of blades, a region of the air flow passage, which is located between the shroud and the main plate, has a cross-sectional area that is taken along a plane including the central axis and is defined as a passage cross-sectional area; and the main plate slope angle is progressively increased from one circumferential location, which is adjacent to the positive pressure surface of the other-side blade, to another circumferential location, which is adjacent to the negative pressure surface of the one-side blade, toward the one circumferential side in the circumferential direction, and thereby, the passage cross-sectional area is progressively decreased from the one circumferential location, which is adjacent to the positive pressure surface of the other-side blade, to the another circumferential location, which is adjacent to the negative pressure surface of the one-side blade, toward the one circumferential side in the circumferential direction.

8. The centrifugal blower according to claim 4, wherein:

each adjacent two of the plurality of blades are defined as a one-side blade and an other-side blade, respectively, and the other-side blade, which is placed on another circumferential side in the circumferential direction relative to the one-side blade, has a positive pressure surface, which faces the one circumferential side in the circumferential direction and receives a positive pressure when the plurality of blades are rotated toward the one circumferential side in the circumferential direction;

among each adjacent two of the plurality of blades, the one-side blade, which is placed on the one circumferential side in the circumferential direction relative to the other-side blade, has a negative pressure surface, which faces the another circumferential side in the circumferential direction and receives a negative pressure when the plurality of blades are rotated toward the one circumferential side in the circumferential direction;

the positive pressure surface of the other-side blade and the negative pressure surface of the one-side blade respectively overlap with the main plate flow passage surface of the main plate in the axial direction;

at each adjacent two of the plurality of blades, a region of the air flow passage, which is located between the shroud and the main plate flow passage surface, has a cross-sectional area that is taken along a plane including the central axis and is defined as a passage cross-sectional area; and the main plate flow passage surface is sloped to progressively approach the one axial side in the axial direction from one circumferential location, which is adjacent to the positive pressure surface of the other-side blade, to another circumferential location, which is adjacent to the negative pressure surface of the one-side blade, toward the one circumferential side in the circumferential direction, and thereby, the passage cross-sectional area is progressively decreased from the one circumferential location, which is adjacent to the positive pressure surface of the other-side blade, to the another circumferential location, which is adjacent to the negative pressure surface of the one-side blade, toward the one circumferential side in the circumferential direction.

9. The centrifugal blower according to claim 2, wherein:

a radially outer part of the tubular portion is shaped in a stepped form and includes at least two outer peripheral surfaces which are displaced from one another in the radial direction and axially extend in the axial direction;

a radially inner part of the main plate is shaped in a stepped form and includes at least two inner peripheral surfaces which are displaced from one another in the radial direction and axially extend in the axial direction; and in a state where the radially outer part of the tubular portion and the radially inner part of the main plate are fitted with each other, each of the at least two outer peripheral surfaces is opposed to a corresponding one of the at least two inner peripheral surfaces through a gap to form a labyrinth structure that limits a flow of the air between the radially outer part of the tubular portion and the radially inner part of the main plate.

10. The centrifugal blower according to claim 9, wherein:

the radially outer part of the tubular portion has a first radial surface that is placed between the at least two outer peripheral surfaces and radially extends in the radial direction;

the radially inner part of the main plate has a second radial surface that is placed between the at least two inner peripheral surfaces and radially extends in the radial direction; and the gap is defined as a first gap, and the first radial surface and the second radial surface are opposed to each other through a second gap to form the labyrinth structure.

* * * * *